US008255222B2

(12) United States Patent
Hirose et al.

(10) Patent No.: US 8,255,222 B2
(45) Date of Patent: Aug. 28, 2012

(54) SPEECH SEPARATING APPARATUS, SPEECH SYNTHESIZING APPARATUS, AND VOICE QUALITY CONVERSION APPARATUS

(75) Inventors: Yoshifumi Hirose, Kyoto (JP); Takahiro Kamai, Kyoto (JP)

(73) Assignee: Panasonic Corporation, Osaka (JP)

( * ) Notice: Subject to any disclaimer, the term of this patent is extended or adjusted under 35 U.S.C. 154(b) by 792 days.

(21) Appl. No.: 12/447,519

(22) PCT Filed: Aug. 6, 2008

(86) PCT No.: PCT/JP2008/002122

§ 371 (c)(1),
(2), (4) Date: Apr. 28, 2009

(87) PCT Pub. No.: WO2009/022454

PCT Pub. Date: Feb. 19, 2009

(65) Prior Publication Data

US 2010/0004934 A1 Jan. 7, 2010

(30) Foreign Application Priority Data

Aug. 10, 2007 (JP) ..... 2007-209824

(51) Int. Cl.
*G10L 13/06* (2006.01)

(52) U.S. Cl. ..... 704/261; 704/268

(58) Field of Classification Search ..... None
See application file for complete search history.

(56) References Cited

U.S. PATENT DOCUMENTS 5,400,434 A * 3/1995 Pearson ..... 704/264
5,749,073 A * 5/1998 Slaney ..... 704/278
5,822,732 A * 10/1998 Tasaki ..... 704/268
5,864,812 A * 1/1999 Kamai et al. ..... 704/268
5,890,108 A * 3/1999 Yeldener ..... 704/208
5,983,173 A * 11/1999 Inoue et al. ..... 704/219
6,081,781 A 6/2000 Tanaka et al.

(Continued)

FOREIGN PATENT DOCUMENTS

JP 4-323699 11/1992

(Continued)

OTHER PUBLICATIONS

Tohkura, Y.; Itakura, F.; Hashimoto, S.; , "Spectral smoothing technique in PARCOR speech analysis-synthesis," Acoustics, Speech and Signal Processing, IEEE Transactions on , vol. 26, No. 6, pp. 587-596, Dec. 1978.*

(Continued)

*Primary Examiner* — Brian Albertalli
(74) *Attorney, Agent, or Firm* — Wenderoth, Lind & Ponack, L.L.P.

(57) ABSTRACT

A speech separating apparatus includes: a PARCOR calculating unit that extracts vocal tract information from an input speech signal; a filter smoothing unit that smoothes, in a first time constant, the vocal tract information extracted by the PARCOR calculating unit; an inverse filtering unit that calculates a filter coefficient of a filter having a frequency amplitude response characteristic inverse to the vocal tract information smoothed by the filter smoothing unit, so as to filter the input speech signal using the filter having the calculated filter coefficient; and a voicing source modeling unit that cuts out, from the input speech signal filtered by the inverse filtering unit, a waveform included in a second time constant shorter than the first time constant, so as to calculate, for each waveform that is taken, voicing source information from the each waveform.

18 Claims, 27 Drawing Sheets

U.S. PATENT DOCUMENTS

| | | | | |
|---|---|---|---|---|
| 6,115,684 | A * | 9/2000 | Kawahara et al. | 704/203 |
| 6,349,277 | B1 | 2/2002 | Kamai et al. | |
| 6,490,562 | B1 | 12/2002 | Kamai et al. | |
| 6,615,174 | B1 * | 9/2003 | Arslan et al. | 704/270 |
| 6,804,649 | B2 * | 10/2004 | Miranda | 704/258 |
| 7,152,032 | B2 * | 12/2006 | Suzuki et al. | 704/262 |
| 7,349,847 | B2 | 3/2008 | Hirose et al. | |
| 7,464,034 | B2 * | 12/2008 | Kawashima et al. | 704/266 |
| 2002/0032563 | A1 | 3/2002 | Kamai et al. | |
| 2003/0088417 | A1 * | 5/2003 | Kamai et al. | 704/258 |
| 2005/0165608 | A1 | 7/2005 | Suzuki et al. | |
| 2006/0136213 | A1 | 6/2006 | Hirose et al. | |

FOREIGN PATENT DOCUMENTS

| | | |
|---|---|---|
| JP | 5-257498 | 10/1993 |
| JP | 9-244694 | 9/1997 |
| JP | 10-143196 | 5/1998 |
| JP | 2000-259164 | 9/2000 |
| JP | 3576800 | 10/2004 |
| JP | 2007-114355 | 5/2007 |
| JP | 4025355 | 12/2007 |
| WO | 2004/040555 | 5/2004 |
| WO | 2006/040908 | 4/2006 |

OTHER PUBLICATIONS

Kain, A.; Macon, M.W.; , "Design and evaluation of a voice conversion algorithm based on spectral envelope mapping and residual prediction," Acoustics, Speech, and Signal Processing, 2001. Proceedings. (ICASSP '01). 2001 IEEE International Conference on , vol. 2, No., pp. 813-816 vol. 2, 2001.*

International Search Report issued Nov. 11, 2008 in the International (PCT) Application of which the prsent application is the U.S. National Stage.

"Methods for subjective determination of transmission quality", ITU-T, Recommendation, p. 800, 1996.

Takahiro Ohtsuka et al., "Robust ARX-based Speech Analysis Method Taking Voicing Source Pulse Train into Account," The Journal of the Acoustical Society of Japan, vol. 58, No. 7, (2002) (and its partial English translation).

* cited by examiner fs: sampling frequency
fs/2: Nyquist frequency
fa: aperiodic boundary frequency

SPEECH SEPARATING APPARATUS, SPEECH SYNTHESIZING APPARATUS, AND VOICE QUALITY CONVERSION APPARATUS

TECHNICAL FIELD

The present invention relates to a speech separating apparatus, a speech synthesizing apparatus, and a voice quality conversion apparatus that separate an input speech signal into voicing source information and vocal tract information.

BACKGROUND ART

In recent years, the development of speech synthesis techniques has enabled generation of very high-quality synthesized speech.

However, the conventional use of such synthesized speech is still centered on uniform purposes, such as reading off news texts in announcer style.

Meanwhile, speech having distinctive features (synthesized speech highly representing personal speech or synthesized speech having a distinct prosody and voice quality, such as the speech style of a high-school girl or speech with a distinct intonation of the Kansai region in Japan) has started to be distributed as a kind of content. Thus, in pursuit of further amusement in interpersonal communication, a demand for creating distinct speech to be heard by the other party is expected to grow.

Meanwhile, the method for speech synthesis is classified into two major methods. The first method is a waveform concatenation speech synthesis method in which appropriate speech elements are selected, so as to be concatenated, from a speech element database (DB) that is previously provided. The second method is an analysis-synthesis speech synthesis method in which speech is analyzed so as to generate synthesized speech based on analyzed parameters.

In terms of converting the voice quality of the above-mentioned synthesized speech in many different ways, in the waveform concatenation speech synthesis method, it is necessary to prepare the same number of the speech element DBs as necessary voice quality types, and to switch between the speech element DBs. Thus, it requires enormous costs to generate synthesized speech having various voice qualities.

On the other hand, in the speech analysis-synthesis method, the analyzed speech parameters are transformed. This allows conversion of the voice quality of the synthesized speech. Generally, a model known as a vocal tract model is used for the analysis. It is difficult, however, to completely separate speech information into voicing source information and vocal tract information. This causes a problem of sound quality degradation as a result of the transformation of incompletely-separated voicing source information (voicing source information including vocal tract information) or incompletely-separated vocal tract information (vocal tract information including voicing source information).

The conventional speech analysis-synthesis method is mainly used for compression coding of speech. In such application, such incomplete separation as described above is not a serious problem. More specifically, it is possible to obtain synthesized speech close to the original speech by re-synthesizing the speech without transforming the parameters. In a typical linear predictive coding (LPC), white noise or an impulse train, either having a uniform spectrum, is assumed for the voicing source. In addition, an all-pole transfer function in which numerators are all constant terms is assumed for the vocal tract. The voicing source spectrum is not uniform in practice. In addition, the transfer function for the vocal tract does not have an all-pole shape due to the influence of the vocal tract having a sophisticated concavo-convex shape and its divergence into the nasal cavity. Therefore, in the LPC analysis-synthesis method, a certain level of sound quality degradation is caused due to model inconsistency. It is typically known that the synthesized speech sounds stuffy-nosed or sounds like a buzzer tone.

To reduce such model inconsistency, the following measures are separately taken for the voicing source and the vocal tract.

Specifically, for the voicing source, preemphasis processing is performed on a speech waveform to be analyzed. A typical vocal tract spectrum has a tilt of −12 dB/oct. and a tilt of +6 dB/oct. is added when the speech is emitted into the air from the lips. Therefore, the spectrum tilt for the vocal-tract voicing source as a result of synthesizing the preemphasized speech waveform is generally considered as −6 dB/oct. Thus, it is possible to compensate the voicing-source spectral tilt by adding a tilt of +6 dB/oct. to the vocal-tract voicing source through differentiation of the speech waveform.

In addition, a method used for the vocal tract is to extract a component inconsistent with the all-pole model as a prediction residual and convolve the extracted prediction residual into the voicing source information, that is, to apply a residual waveform to a driving voicing source for the synthesis. This causes the waveform of the synthesized speech to completely match the original speech. A code excited linear prediction (CELP) is a technique in which the residual waveform is vector-quantized and transmitted as a code number.

According to the technique, the re-synthesized speech has a satisfactory voice quality even when the voicing source information and the vocal tract information are not completely separated due to inaccuracy of analysis attributed to low consistency of the linear prediction model.

However, in an application where voice quality is converted with varying parameters, it is important to separate the voicing source information and the vocal tract information as accurately as possible. That is, even when it is intended to change parameters attributable to the vocal tract (for example, formant center frequency), the characteristics of the voicing source are changed at the same time. Therefore, in order to allow control of the vocal tract and the voicing source separately, it is necessary to accurately separate the information regarding these two.

In the speech synthesis-analysis method, a technique for performing more accurate separation of the voicing source information and the vocal tract information is, for example, to obtain the vocal tract information, which is not sufficiently obtained in one LPC analysis, through plural LPC analyses, so as to flatten the spectral information of the voicing source (for example, see Patent Reference 1).

FIG. 1 is a block diagram showing a structure of a conventional speech analyzing apparatus described in Patent Reference 1.

Hereinafter, an operation of the conventional speech analyzing apparatus shown in FIG. 1 shall be described. An input speech signal 1*a* is inputted to a first spectrum analysis unit 2*a* and an inverse filtering unit 4*a*. The first spectrum analysis unit 2*a* analyses the input speech signal 1*a* so as to extract a first spectral envelope parameter, and outputs the extracted first spectral envelope parameter to a first quantization unit 3*a*. The first quantization unit 3*a* quantizes the first spectral envelope parameter so as to obtain a first quantized spectral envelope parameter, and outputs the obtained first quantized spectral envelope parameter to an inverse filtering unit 4*a*. The inverse filtering unit 4*a* inverse-filters the input speech signal 1*a* using the first quantized spectral envelope parameter so as to obtain a prediction residual signal, and inputs the obtained prediction residual signal to a second spectrum analysis unit 5*a* and a voicing source coding unit 7*a*. The second spectrum analysis unit 5*a* analyzes the prediction residual signal so as to extract a second spectral envelope parameter, and outputs the extracted second spectral envelope parameter to a second quantization unit 6*a*. The second quantization unit 6*a* quantizes the second spectral envelope parameter so as to obtain a second quantized spectral envelope parameter, and outputs the obtained second quantized spectral envelope parameter to a voicing source coding unit 7*a* and the outside. The voicing source coding unit 7*a* extracts a voicing source signal using the prediction residual signal and the second quantized spectral envelope parameter, codes the extracted voicing source signal, and outputs a coded voicing source that is the coded voicing source signal. These coded voicing source, first quantized spectral envelope parameter, and second quantized spectral envelope parameter constitute the coding result.

By thus configuring the speech analyzing apparatus, spectrum envelop characteristics, which cannot conventionally be removed only by the first spectrum analysis unit 2*a*, are extracted by the second spectrum analysis unit 5*a*. This allows flattening of the frequency characteristics of the voicing source information outputted from the voicing source coding unit 7*a*.

In addition, another related technique is embodied as a speech enhancement apparatus which separates the input speech into voicing source information and vocal tract information, enhances the separated voicing source and vocal tract information individually, and generates synthesized speech using the enhanced voicing source information and vocal tract information (for example, see Patent Reference 2).

The speech enhancement apparatus calculates, when separating the input speech, an autocorrelation-function value of the input speech of a current frame. The speech enhancement apparatus also calculates an average autocorrelation-function value through weight-averaging of the autocorrelation-function value of the input speech of the current frame and the autocorrelation-function value of the input speech of a previous frame. This offsets rapid change in the shape of the vocal tract between the frames. Thus, it is possible to prevent rapid gain change at the time of enhancement. Accordingly, this makes it less likely to cause unusual phone.

[Patent Reference 1] Japanese Unexamined Patent Application Publication No. 5-257498 (pages 3 to 4, FIG. 1)

[Patent Reference 2] International Application Published under the Patent Cooperation Treaty No. 2004/040555)

SUMMARY OF THE INVENTION

Problems that Invention is to Solve

However, in the conventional LPC analysis, a phenomenon is observed in which the LPC coefficient (linear predictive coefficient) that is the result of the analysis temporally fluctuates under the influence of the pitch period of the speech. This phenomenon is also observed in a PARCOR coefficient that is mathematically equivalent to the LPC coefficient shown in FIGS. 5A to 5D to be hereinafter described. Such fine fluctuations are caused by the factors described below. Specifically, a normal analysis interval is set to a length including two pitch periods or so. In addition, when, in the analysis, clipping an interval by using a window function such as Hanning window or Hamming window, it is commonly practiced to remove the influence of both ends of the interval resulting from the clipping of the interval. However, the positional relationship between these window functions and the speech waveform causes waveform energy included in the analysis interval to fluctuate in association with the pitch period.

In the conventional LPC analysis, the fluctuations inherent to speech or temporal fluctuations of speech attributed to the position of the analysis window are inevitably extracted as part of vocal tract information. This, as a result, causes a problem of catching a quick movement that is not inherent to the vocal tract as part of the vocal tract information, while removing a quick movement that is inherent to the voicing source from the voicing source information. As a result, when converting the voice quality by transforming a vocal tract parameter, the vocal tract parameter is transformed with such fine fluctuations still being retained. This causes a problem of difficulty of obtaining smooth speech. That is, there is a problem that the voicing source and the vocal tract cannot be separated properly.

Thus, when transforming the vocal tract information or the voicing source information, each of them includes information other than its inherent information. This results in transforming the vocal tract information or voicing source information that is deformed under the influence of such non-inherent information. Eventually, a problem remains that the sound quality of the synthesized speech is caused to degrade when voice quality is transformed.

For example, original fluctuation components derived from the original pitch and included in the vocal tract information still remain even when the pitch is changed. This causes sound quality to degrade.

Furthermore, for the speech enhancement apparatus described in Patent Reference 2, obtainable information is voicing source information. Conversion to an arbitrary voice quality requires a transformable parameter representation while holding, concurrently, the vocal tract information and the voicing source information of the source speech. However, there is a problem that the waveform information as described in Patent Reference 2 does not allow such conversion with high degrees of freedom.

In addition, Patent Reference 1 discloses that the voicing source is approximated to an impulse voicing source assumed in the LPC by flattening the frequency characteristics of the voicing source. However, real voicing source information is not consistent with impulses. Thus, when simply performing an analysis and synthesis, it is possible to obtain high-quality synthesized speech using a conventional technique without transforming the vocal tract information and the voicing source information. However, this presents a problem, in converting the voice quality, that the vocal tract information and the voicing source information cannot be controlled independently of each other, for example, controlling only the vocal tract information or only the voicing source information is not possible.

Furthermore, for the speech enhancement apparatus described in Patent Reference 2, obtainable voicing source information is waveform information. Thus, the problem is that it is not possible to arbitrarily convert the voice quality without further processing.

The present invention is conceived in view of the above-described problems, and it is an object of the present invention to provide a speech separating apparatus, a speech synthesizing apparatus, and a voice quality conversion apparatus that separate voicing source information and vocal tract information in a manner more appropriate for voice quality conversion, to thereby make it possible to prevent the degradation of voice quality resulting from the transforming each of the voicing source information and vocal tract information.

In addition, the present invention also aims to provide a speech separating apparatus, a speech synthesizing apparatus, and a voice quality conversion apparatus that allow efficient conversion of voicing source information.

Means to Solve the Problems

In order to achieve the above object, the speech separating apparatus according to the present invention is a speech separating apparatus that analyses an input speech signal so as to extract vocal tract information and voicing source information, and includes: a vocal tract information extracting unit that extracts vocal tract information from the input speech signal; a filter smoothing unit that smoothes, in a first time constant, the vocal tract information extracted by the vocal tract information extracting unit; an inverse filtering unit that calculates a filter having an inverse characteristic to a frequency response of the vocal tract information smoothed by the filter smoothing unit and filters the input speech signal by using the calculated filter; and a voicing source modeling unit that takes, from the input speech signal filtered by the inverse filtering unit, a waveform included in a second time constant shorter than the first time constant and calculates, for each waveform that is taken, voicing source information from the each waveform.

According to this configuration, the vocal tract information including voicing source information is smoothed in a time axis direction. This allows extraction of vocal tract information that does not include fluctuations derived from the pitch period of the voicing source.

In addition, a filter coefficient is calculated for a filter having a frequency amplitude response characteristic inverse to the vocal tract information that has been smoothed, so as to filter the input speech signal by using the filter. Furthermore, voicing source information is obtained from the input speech that has been filtered. This allows obtainment of voicing source information including information that is conventionally mixed in the vocal tract information.

Furthermore, the voicing source modeling unit converts the input speech signal into a parameter, with a shorter time constant than a time constant used for the smoothing by the filter smoothing unit. This allows modeling of the voicing source information including fluctuation information that is conventionally lost in the smoothing by the filter smoothing unit.

Accordingly, this allows modeling of vocal tract information that is more stable than before and the voicing source information including temporal fluctuations that are conventionally removed.

In addition, the voicing source information is parameterized. This allows efficient conversion of the voicing source information.

Preferably, the speech separating apparatus described above further includes a synthesis unit that generates synthesized speech by generating a voicing source waveform by using a voicing source information parameter outputted from the voicing source modeling unit, and filtering the generated voicing source waveform by using the vocal tract information smoothed by the filter smoothing unit.

It is possible to generate synthesized speech using the above-described voicing source information and vocal tract information. This makes it possible to generate synthesized speech having fluctuations. With this, it becomes possible to generate highly natural synthesized speech.

Further preferably, the speech separating apparatus described above includes: a target speech information holding unit that holds vocal tract information and the parameterized voicing source information on a target voice quality; a conversion ratio input unit that inputs a conversion ratio for converting the input speech signal into the target voice quality; a filter transformation unit that converts, at the conversion ratio inputted by the conversion ratio input unit, the vocal tract information smoothed by the filter smoothing unit into the vocal tract information on the target voice quality, which is held by the target speech information holding unit; and a voicing source transformation unit that converts, at the conversion ratio inputted by the conversion ratio input unit, the voicing source information parameterized by the voicing source modeling unit into the voicing source information on the target voice quality, which is held by the target speech information holding unit, and the synthesis unit generates synthesized speech by generating a voicing source waveform by using the voicing source information transformed by the voicing source transformation unit, and filtering the generated voicing source waveform by using the vocal tract information transformed by the filter transformation unit.

It is possible to transform the vocal tract information while retaining fluctuation information. This prevents the degradation of sound quality.

Even when voice quality conversion processing is performed on the voicing source information and the vocal tract information independently of each other, it is possible to convert only the information that should originally be converted. This prevents the degradation of sound quality as a result of the voice quality conversion.

Note that the present invention can be realized not only as a speech separating apparatus including these characteristics but also as a speech separation method including, as steps, characteristic units included in the speech separating apparatus, and also as a program causing a computer to execute such characteristic steps included in the speech separation method. Additionally, it goes without saying that such a program can be distributed through a recording medium such as a Compact Disc-Read Only Memory (CD-ROM) and a communication network such as the Internet.

Effects of the Invention

Vocal tract information including voicing source information is smoothed in a time axis direction. This allows extraction of vocal tract information that does not include fluctuations derived from the pitch period of a voicing source.

In addition, a filter coefficient is calculated for a filter having a frequency amplitude response characteristic inverse to the vocal tract information that has been smoothed, so as to filter the input speech signal by using the filter. Furthermore, parameterized voicing source information is obtained from the input signal that has been filtered. This allows obtainment of voicing source information including information that is conventionally mixed in the vocal tract information.

Furthermore, the input speech signal is converted into a parameter, with a shorter time constant than a time constant used for the smoothing. This allows modeling of the voicing source information by including fluctuation information that is conventionally lost in the smoothing.

Accordingly, this allows modeling of the vocal tract information that is more stable than before and the voicing source information including temporal fluctuations that are conventionally removed.

In addition, it is also possible to generate synthesized speech having fluctuations. With this, it becomes possible to generate highly natural synthesized speech.

Even when transforming the vocal tract information, it is possible to transform the vocal tract information while retaining fluctuation information. This prevents the degradation of sound quality.

Even when voice quality conversion processing is performed on the voicing source information and the vocal tract information independently of each other, it is possible to convert only the information that should originally be converted. This prevents the degradation of sound quality as a result of the voice quality conversion.

In addition, the voicing source information is parameterized. This allows efficient conversion of the voicing source information.

NUMERICAL REFERENCES

Figure 1:
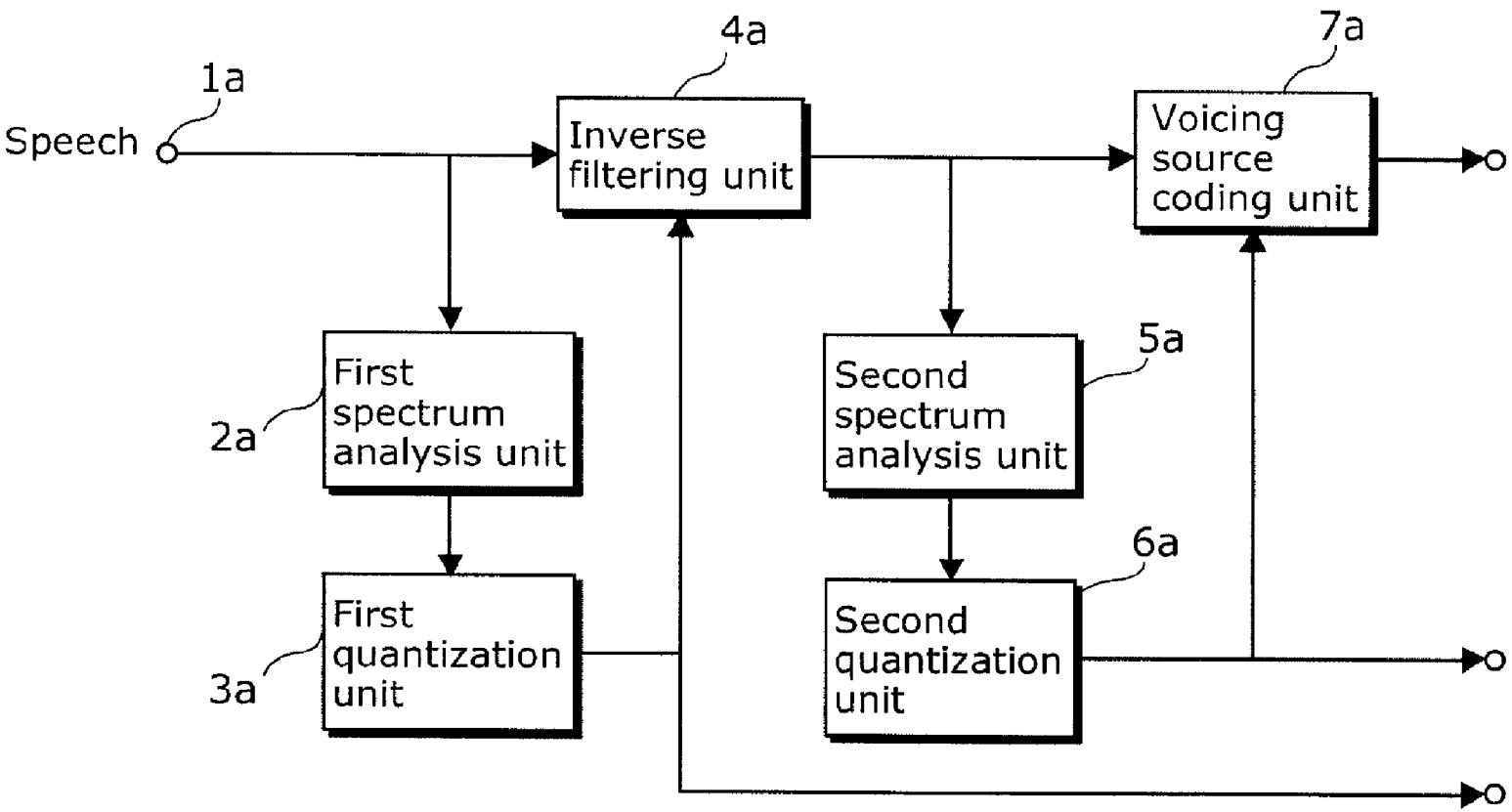
FIG. 1 PRIOR ART
FIG. 1 is a block diagram showing a structure of a conventional speech analyzing apparatus described in Patent Reference 1.

101 LPC analysis unit
102 PARCOR calculating unit
103 Filter smoothing unit
104 Inverse filtering unit
105 Voicing source modeling unit
106 Filter transformation unit
107 Target speech information holding unit
108 Voicing source transformation unit
109 Synthesis unit
110 Conversion ratio input unit
201 ARX analysis unit

DETAILED DESCRIPTION OF THE INVENTION

Hereinafter, embodiments of the present invention shall be described with reference to the drawings.

First Embodiment

Figure 2:
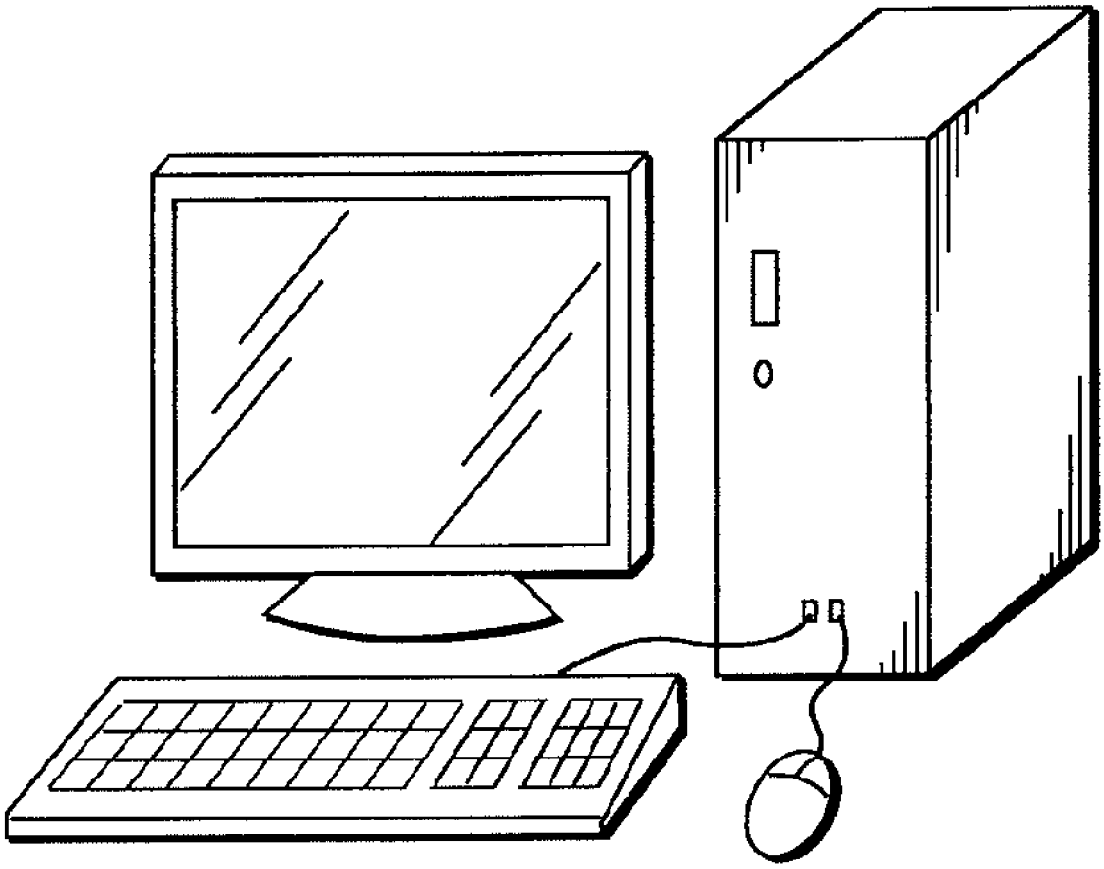
FIG. 2 is an external view of a voice quality conversion apparatus in a first embodiment of the present invention.

FIG. 2 is an external view of a speech separating apparatus in a first embodiment of the present invention. The speech separating apparatus is configured with a computer.

Figure 3:
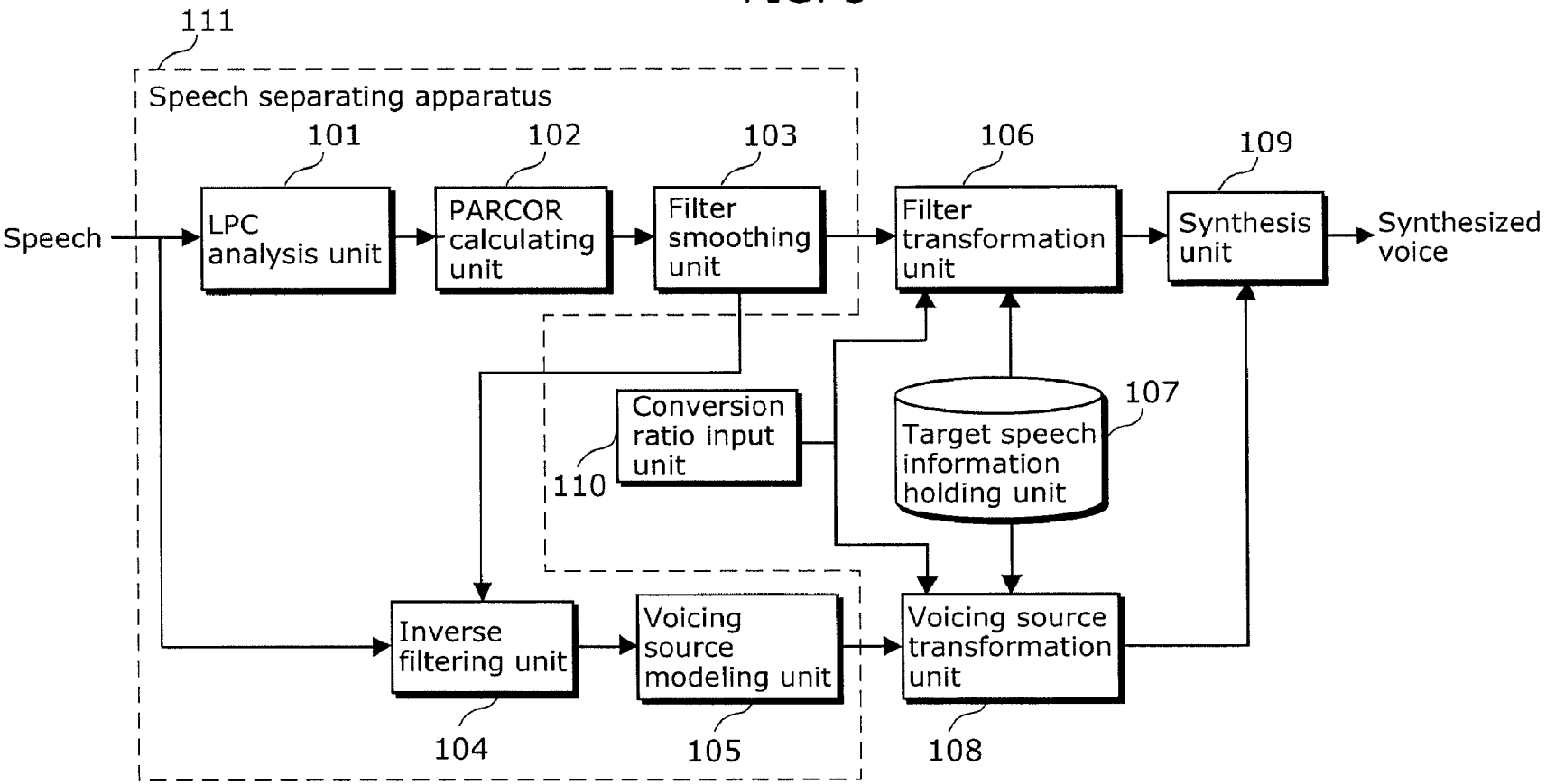
FIG. 3 is a block diagram showing a configuration of a voice quality conversion apparatus in the first embodiment of the present invention.

FIG. 3 is a block diagram showing a configuration of a voice quality conversion apparatus in the first embodiment of the present invention.

The voice quality conversion apparatus is an apparatus that generates synthesized speech by converting the voice quality of inputted speech into a target voice quality and outputs the synthesized speech, and includes a speech separating apparatus 111, a filter transformation unit 106, a target speech information holding unit 107, voicing source transformation unit 108, a synthesis unit 109, and a conversion ratio input unit 110.

The speech separating apparatus 111 is an apparatus that separates voicing source information and vocal tract information from the input speech, and includes a linear predictive coding (LPC) analysis unit 101, a partial auto correlation (PARCOR) calculating unit 102, a filter smoothing unit 103, an inverse filtering unit 104, and a voicing source modeling unit 105.

The LPC analysis unit 101 is a processing unit that extracts vocal tract information by performing a linear predictive coding analysis on the inputted speech.

The PARCOR calculating unit 102 is a processing unit that calculates a PARCOR coefficient based on a linear predictive coefficient analyzed by the LPC analysis unit 101. The LPC coefficient and the PARCOR coefficient are mathematically equivalent, and the PARCOR coefficient also represents vocal tract information.

The filter smoothing unit 103 is a processing unit that smoothes the PARCOR coefficient, which is calculated by the PARCOR calculating unit 102, in a time direction with respect to each dimension.

The inverse filtering unit 104 is a processing unit that calculates a coefficient, from the PARCOR coefficient smoothed by the filter smoothing unit 103, for a filter having an inverse frequency amplitude response characteristic and performs inverse filtering on the speech using the calculated inverse filter, to thereby calculate voicing source information.

The voicing source modeling unit 105 is a processing unit that performs modeling on the voicing source information calculated by the inverse filtering unit 104.

The filter transformation unit 106 is a processing unit that converts the PARCOR coefficient smoothed by the filter smoothing unit 103, based on the target filter information held by the target speech information holding unit 107 to be hereinafter described and the conversion ratio inputted by the conversion ratio input unit 110, to thereby convert the vocal tract information.

The target speech information holding unit 107 is a storage apparatus that holds filter information on the target voice quality, and is configured with, for example, a hard disk and so on.

The voicing source transformation unit 108 is a processing unit that transforms the voicing source information parameterized into a model by the voicing source modeling unit 105, based on the voicing source information held by the target speech information holding unit 107 and the conversion ratio inputted by the conversion ratio input unit 110, to thereby convert the voicing source information.

The synthesis unit 109 is a processing unit that generates synthesized speech using the vocal tract information converted by the filter transformation unit 106 and the voicing source information converted by the voicing source transformation unit 108.

The conversion ratio input unit 110 is a processing unit that inputs a ratio indicating a degree to which the input speech can be approximated to the target speech information held by the target speech information holding unit 107.

The voice quality conversion apparatus is thus configured with the constitutional elements described above. The respective processing units included in the voice quality conversion apparatus are realized through execution of a program for realizing these processing units on a computer processor as shown in FIG. 2. In addition, various data is stored in the computer memory and used for the processing executed by the processor.

Next, an operation of each of the constituent elements shall be described in detail.

<LPC Analysis Unit 101>

The LPC analysis unit 101 performs a linear predictive analysis on inputted speech. The linear predictive analysis is to predict a sample value $y_n$ having a speech waveform from p sample values ($y_{n-1}$, $y_{n-2}$, $y_{n-3}$, . . . , $y_{n-p}$) that temporally precede the sample value $y_n$, and can be represented by Equation 1.

[Expression 1]

$$y_n \cong \alpha_1 y_{n-1} + \alpha_2 y_{n-2} + \alpha_3 y_{n-3} + \Lambda + \alpha_p y_{n-p} \quad \text{(Equation 1)}$$

A coefficient $a_i$ (i=1 to p) for the p sample values can be calculated using a correlation method, a covariance method, or the like. Where the calculated coefficient $a_i$ is used, an inputted speech signal S(z) can be represented by Equation 2.

[Expression 2]

$$S(z) = \frac{1}{A(z)}U(z) \qquad \text{(Equation 2)}$$
$$A(z) = 1 + \alpha_1 z^{-1} + \alpha_2 z^{-2} + \Lambda + \alpha_n z^{-n}$$

Here, U(z) represents a signal obtained through inverse filtering of the input speech S(z) using 1/A(z).

<PARCOR Calculating Unit 102>

Generally, in order to transform the vocal tract information calculated based on the LPC analysis and so on, the vocal tract information is transformed by extracting correspondence of feature points (for example, formant) in spectral envelope, and then interpolating the vocal tract information between such feature points found corresponding to each other.

Figure 4:
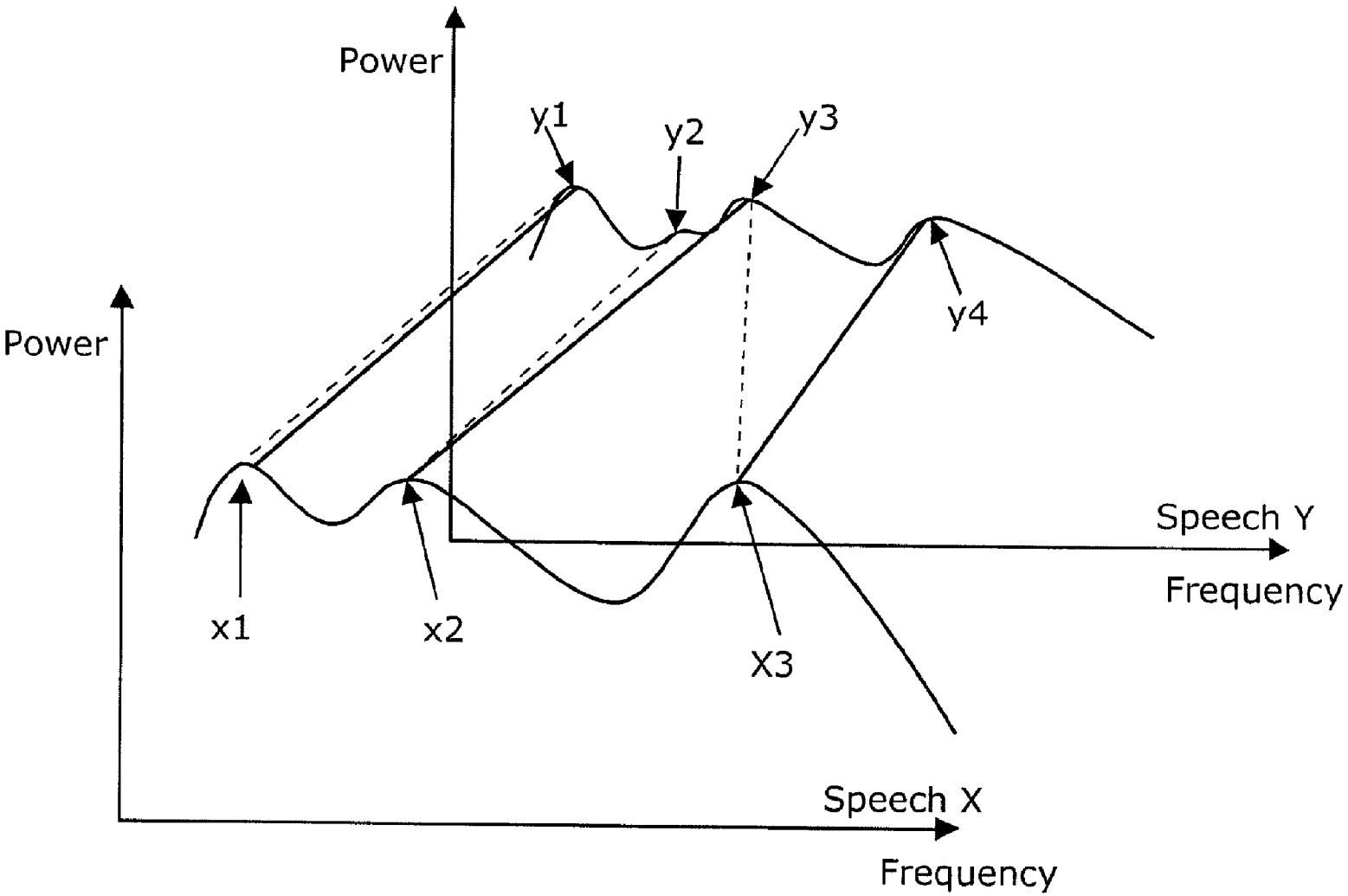
FIG. 4 is a diagram showing spectral-envelope correspondence in a conventional voice quality conversion.
Figure 5A:
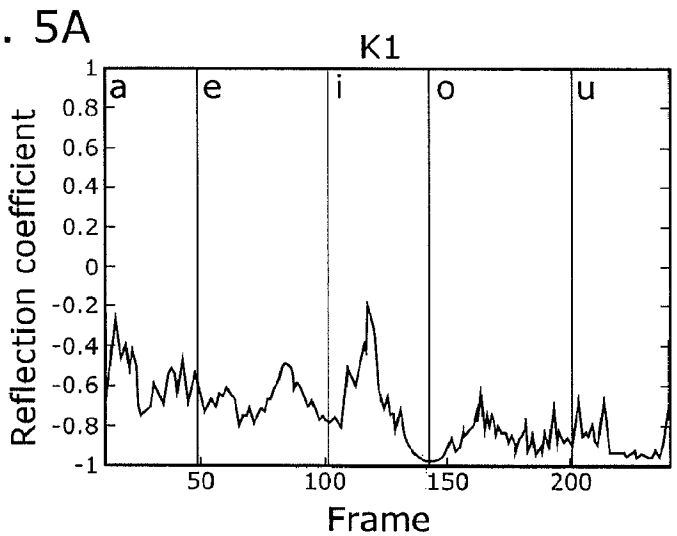
FIG. 5A is a diagram showing an example of a first-order PARCOR coefficient based on an LPC analysis.
Figure 5B:
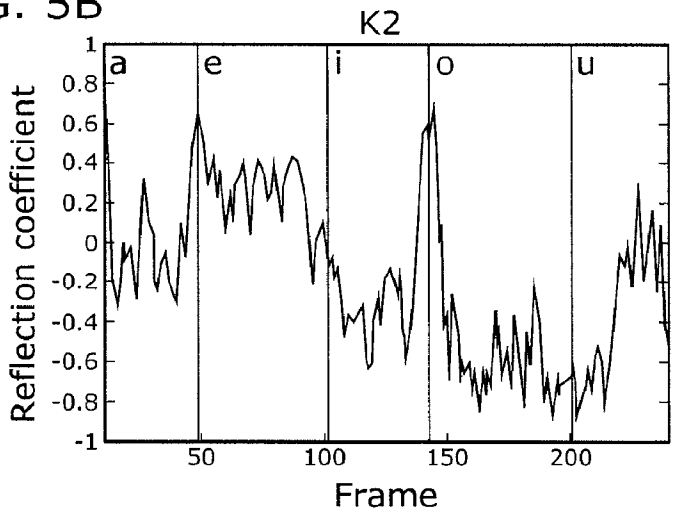
FIG. 5B is a diagram showing an example of a second-order PARCOR coefficient based on the LPC analysis.
Figure 5C:
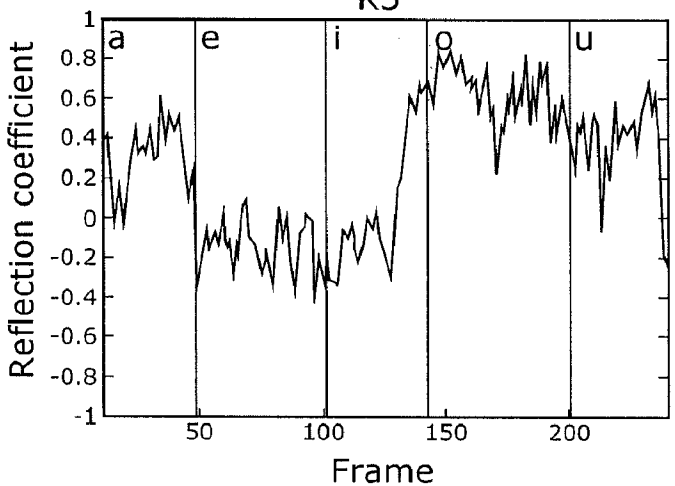
FIG. 5C is a diagram showing an example of a third-order PARCOR coefficient based on the LPC analysis.
Figure 5D:
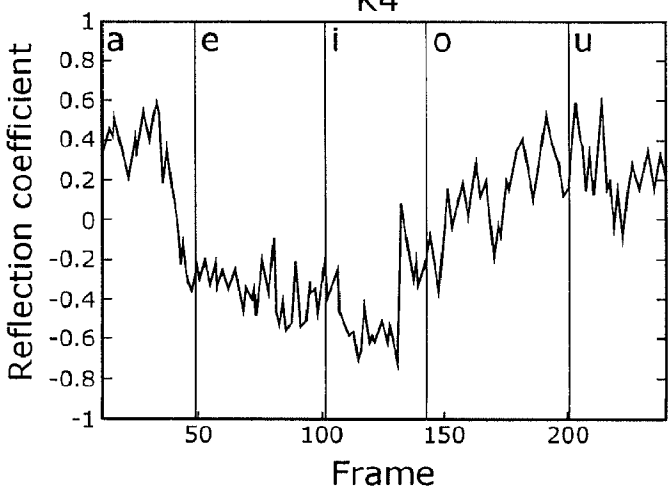
FIG. 5D is a diagram showing an example of a fourth-order PARCOR coefficient based on the LPC analysis.
Figure 6A:
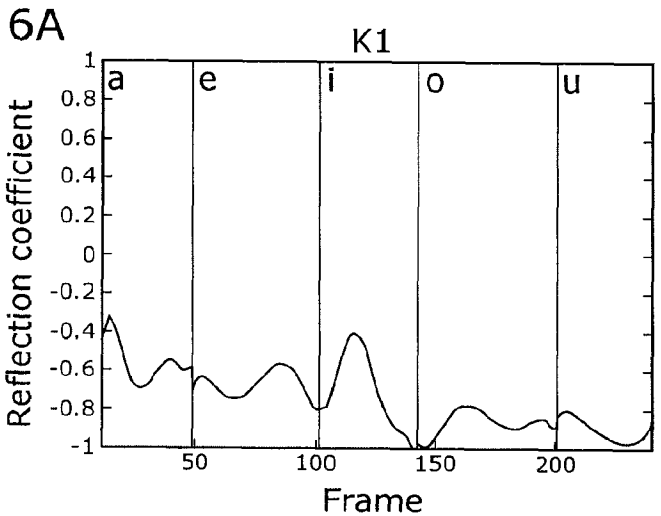
FIG. 6A is a diagram showing a result of smoothing through approximation using a polynomial function, a first-order PARCOR coefficient based on the LPC analysis.
Figure 6B:
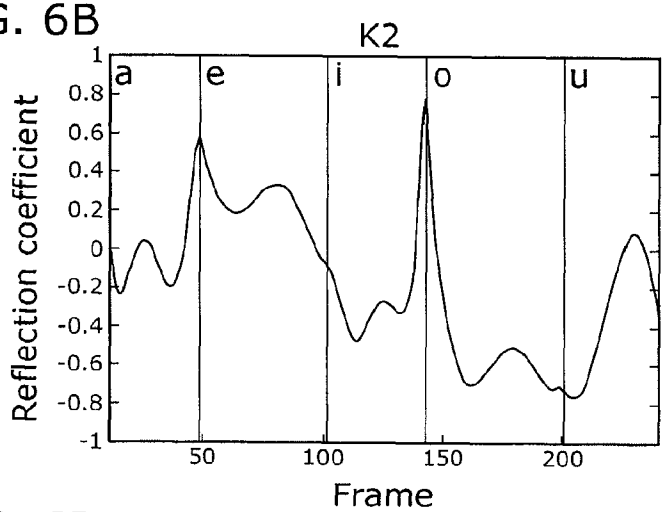
FIG. 6B is a diagram showing a result of smoothing, through approximation using a polynomial function, a second-order PARCOR coefficient based on the LPC analysis.
Figure 6C:
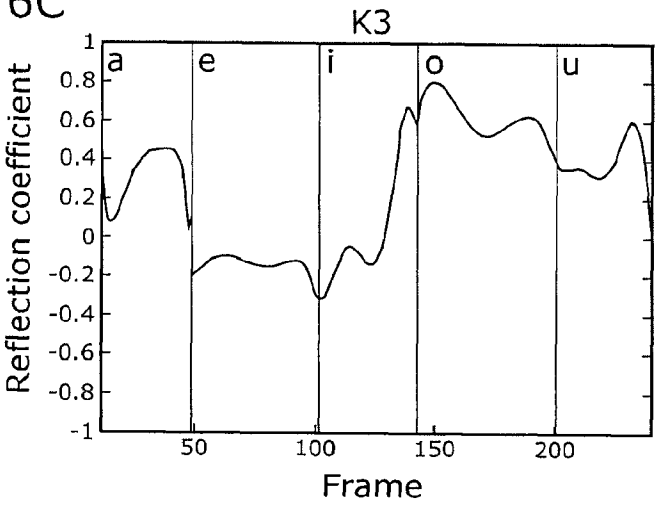
FIG. 6C is a diagram showing a result of smoothing, through approximation using a polynomial function, a third-order PARCOR coefficient based on the LPC analysis.
Figure 6D:
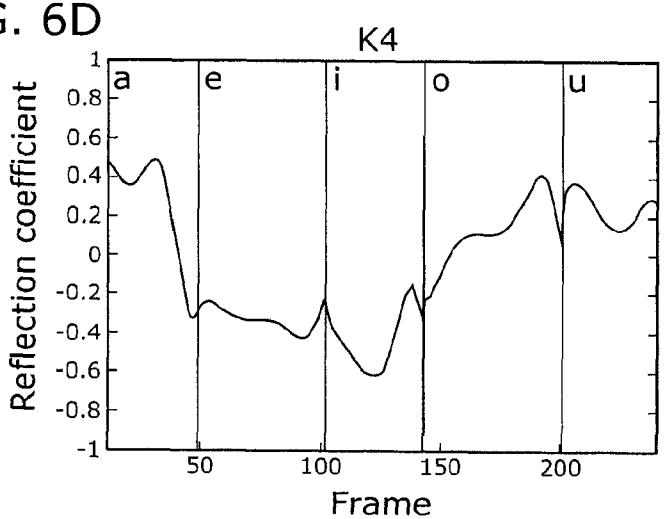
FIG. 6D is a diagram showing a result of smoothing, through approximation using a polynomial function, a fourth-order PARCOR coefficient based on the LPC analysis.

FIG. 4 shows an example of feature-point correspondence between two utterances of speech. In the figure, three points x1, x2, and x3 are extracted as spectral feature points of Speech X, and four points y1, y2, y3, and y4 are extracted as spectral feature points of Speech Y.

However, when obtaining a spectral envelope by LPC analysis or the like, each spectral feature point does not always correspond to the formant, and there is a case where a relatively weak peak value is selected as a feature point (y2). Such a feature point is hereinafter referred to as a pseudo formant.

In extracting the correspondence, there is a case where the formant and the pseudo formant are incorrectly extracted to correspond to each other. The figure shows an example where the correspondence, which should normally be: x1 to y1, x2 to y3, and x3 to y4 (shown in full line in the figure), results in such incorrect correspondence as: x1 to y1, x2 to y2, and x3 to y3 indicated in dashed line).

As a result, when interpolating the vocal tract information between such feature points incorrectly extracted to correspond to each other, an inappropriate value is calculated for the vocal tract information as a result of the correspondence of x3 to y3, which should not normally correspond to each other.

The PARCOR calculating unit 102 calculates a PARCOR coefficient (partial autocorrelation coefficient) $k_i$, using the linear predictive coefficient $a_i$ analyzed by the LPC analysis unit 101. For the calculation method, it is possible to apply the Levinson-Durbin-Itakura algorithm to perform the calculation. Note that the PARCOR coefficient has the features below.

(1) The fluctuations of a lower-order coefficient have a larger influence on the spectrum, and the higher the order of the coefficient is, the less influence such fluctuations have over the spectrum.

(2) The fluctuations of a high-order coefficient flatly influence the entire region.

Due to such features of the PARCOR coefficient, information, which appears as the pseudo formant (the peak value having a weak spectral envelope), is represented as a high-order parameter in the PARCOR coefficient. Therefore, such interpolation in terms of the PARCOR coefficient, performed in an identical dimension, allows extraction of correspondence very close to the feature points on the spectrum. A specific example of this shall be given below with the description of the filter smoothing unit 103.

<Filter Smoothing Unit 103>

FIGS. 5A to 5D show PARCOR coefficients of first order to fourth order, respectively, when continuous utterances /aeiou/ of a male speaker is represented by the above-described PARCOR coefficients (reflection coefficients). In each graph, a horizontal axis indicates an analysis frame number, and a vertical axis indicates the PARCOR coefficient. Note that the analysis cycle is 5 msec.

The PARCOR coefficients shown in FIGS. 5A to 5D are parameters that should essentially be equivalent to the vocal tract area functions representing the shape of the vocal tract. Thus, the PARCOR coefficients should fluctuate at nearly the same speed as the movement of the vocal tract. That is, the voicing source information associated with vocal cord vibration can vary at time intervals close to the fundamental frequency of the speech (in a range of frequency from tens of Hz to hundreds of Hz). On the other hand, the vocal tract information indicating the shape of the vocal tract from the vocal cord to the lips is considered to vary at time intervals longer than the vocal cord vibration. For example, the vocal tract information varies at time intervals close to the speed of the speech (in a conversation style, the speech speed represented by morae/sec). However, FIGS. 5A to 5D show that the temporal fluctuations of the parameter in each dimension are faster than the normal movement of the vocal tract. That is, the figures show that the vocal tract information analyzed by the LPC analysis includes motion information that is faster than the normal movement of the vocal tract. This information can be interpreted as temporal fluctuations of the voicing source information. As above, such incomplete separation between the vocal tract information and the voicing source information gives rise to a problem, in converting voice quality, that these categories of information cannot be transformed independently of each other. That is, although it is only intended to transform the vocal tract information, voicing source information is involved in the conversion, which causes negative effects such as phonemic ambiguity.

The filter smoothing unit 103 performs smoothing in the time direction with respect to each dimension of the PARCOR coefficient calculated by the PARCOR calculating unit 102.

The smoothing method is not particularly limited. For example, it is possible to smooth the PARCOR coefficient by approximating the PARCOR coefficient with respect to each dimension using a polynomial as represented by Equation 3.

[Expression 3]

$$\hat{y}_a = \sum_{i=0}^{p} a_i x^i \qquad \text{(Equation 3)}$$

Here,

[Expression 4]

$$\hat{y}_a \qquad \text{[Expression 4]}$$

represents the PARCOR coefficient approximated using the polynomial, with $a_i$ representing the coefficient of polynomial and x representing time.

At this time, as a time constant to which the polynomial approximation is applied (corresponding to a first time constant), it is possible to set, for example, a phoneme section as a unit of the approximation. In addition, instead of the phoneme section, it is also applicable to set, as the time constant, a length from the center of a phoneme to the center of the subsequent phoneme. Note that the phoneme section shall hereinafter be described as a unit of smoothing.

FIGS. 6A to 6D show PARCOR coefficients of first order to fourth order, respectively, when the PARCOR coefficients are smoothed in a time direction in units of phoneme, using quintic polynomial approximation. The horizontal and vertical axes of the graph are the same as in FIGS. 5A to 5D.

In the present embodiment, a fifth order is given as an example for describing the order of polynomial, but the polynomial need not be quintic. Note that a regression line of each phoneme, other than the polynomial approximation, is also applicable in approximating the PARCOR coefficient.

The figures show that the PARCOR coefficients are smoothed for each phoneme after the smoothing.

Note that the smoothing method is not limited to this, and smoothing through moving average or the like is also applicable.

On a phoneme boundary, the PARCOR coefficient is discontinuous, but it is possible to prevent such discontinuity by interpolating the PARCOR coefficient by providing an appropriate transitional section. The interpolation method is not particularly limited, but may be linear interpolation, for example.

Figure 7:
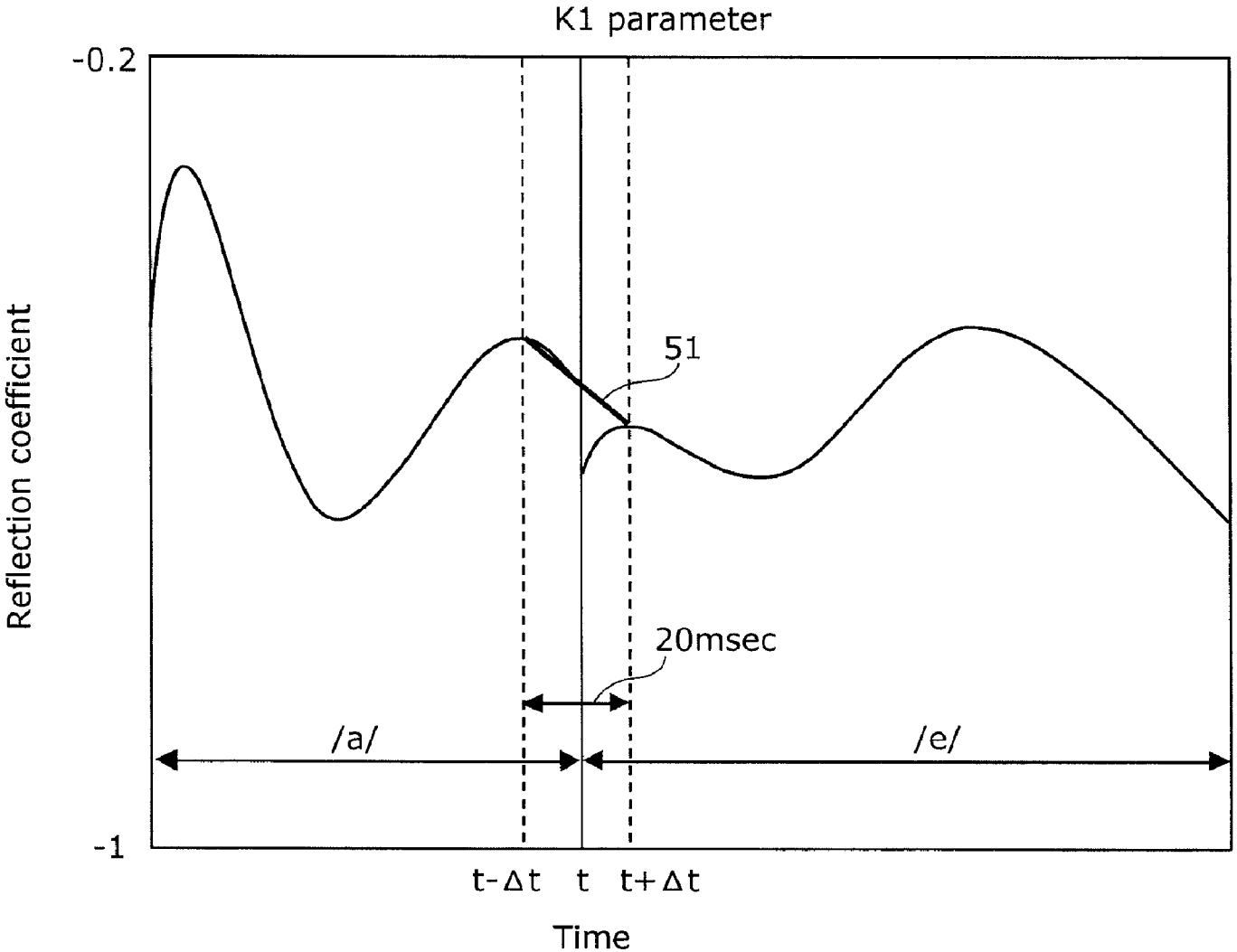
FIG. 7 is a diagram showing a method of interpolating a PARCOR coefficient in a transitional section on a phonemic boundary.

FIG. 7 shows an example of interpolating a PARCOR coefficient value by proving a transitional section. The figure shows a reflection coefficient at a concatenation boundary between the vowel /a/ and the vowel /e/. The figure shows discontinuity of the reflection coefficient at boundary time (t). Thus, an appropriate transitional time (Δt) from the boundary time is provided to linearly interpolate the reflection coefficient between t−Δt and t+Δt, to thereby obtain a reflection coefficient 51 after the interpolation. This processing prevents the discontinuity of the reflection coefficient at the phoneme boundary. For the transitional time, for example, approximately 20 msec is sufficient. Alternatively, the transitional time may be changed according to the length of vowel duration. For example, the transitional section is set shorter when the vowel section is short. Reversely, the transitional section may be set longer when the vowel section is long.

Figure 8A:
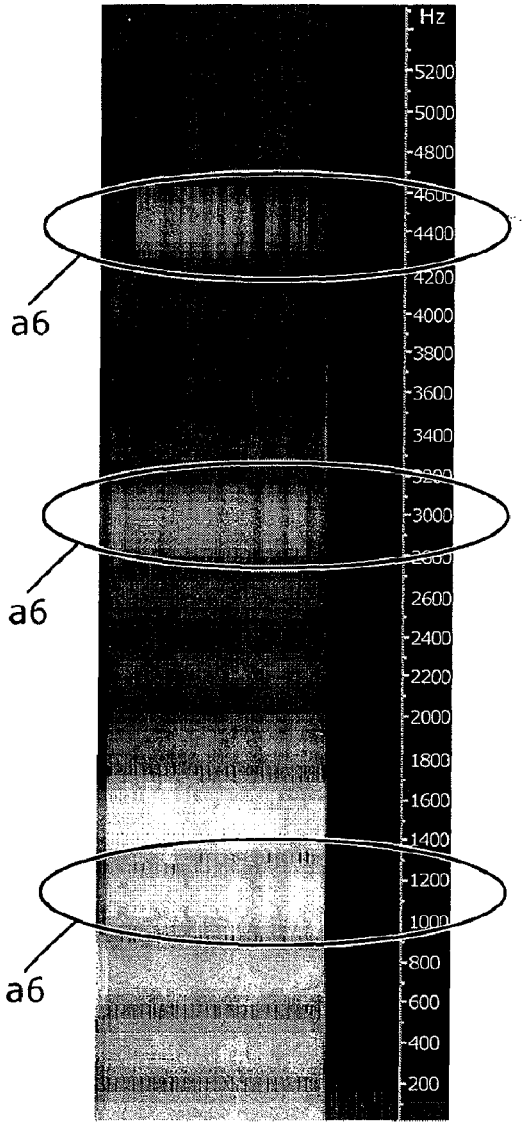
FIG. 8A is a diagram showing a spectrum of synthesized speech when smoothing is not performed by the filter smoothing unit.
Figure 8B:
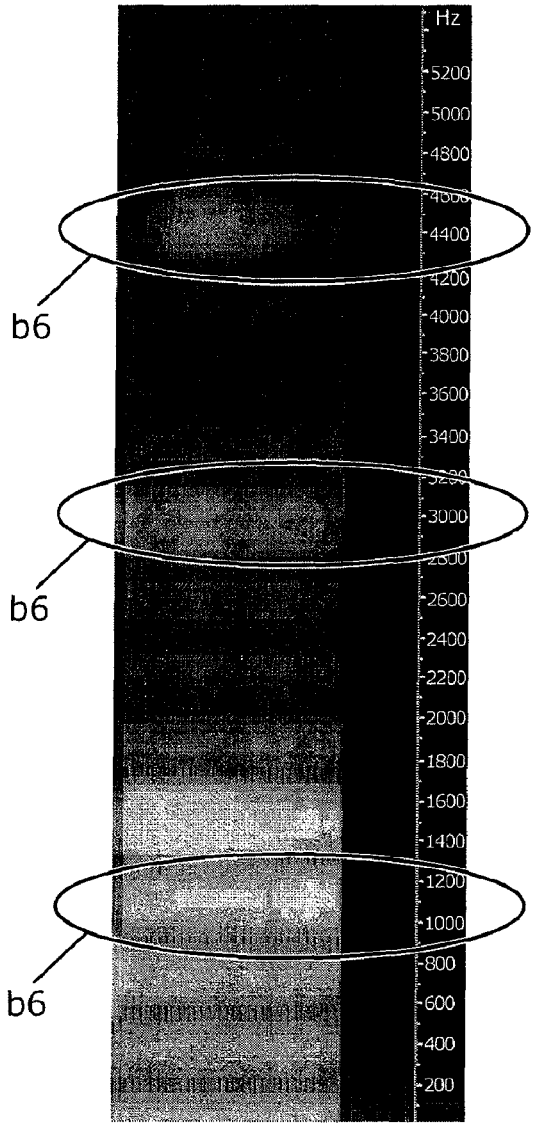
FIG. 8B is a diagram showing a spectrum of synthesized speech when smoothing is performed by the filter smoothing unit.

FIGS. 8A and 8B show spectrograms (with a horizontal axis indicating time and a vertical axis indicating frequency) of synthesized speech when the speech is synthesized by analyzing an utterance /a/ and using the voicing source as an impulse voicing source. FIG. 8A shows a spectrum of synthesized speech when the speech is synthesized using the impulse voicing source without smoothing the vocal tract information. FIG. 8B shows a spectrum of the synthesized speech when the speech is synthesized through the smoothing of the vocal tract information according to the smoothing described above and synthesizing the speech using the impulse voicing source.

FIG. 8A shows that a portion indicated by a numeral a6 includes vertical stripes. Such vertical stripes are caused by the rapid fluctuations of the PARCOR coefficient. On the other hand, the same portion appended with a numeral b6 has nearly no vertical stripes after the smoothing. This clearly shows that the smoothing of the filter parameter allows removal of information that is not inherent to the vocal tract.

<Inverse Filtering Unit 104>

The inverse filtering unit 104 forms a filter having an inverse characteristic to the filter parameter by using the PARCOR coefficient smoothed by the filter smoothing unit 103. The inverse filtering unit 104 filters input speech using the formed filter, so as to output a voicing source waveform of the input speech.

<Voicing Source Modeling Unit 105>

Figure 9A:
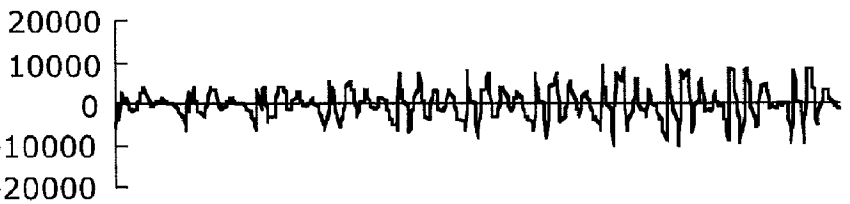
FIG. 9A is a diagram showing an example of a speech waveform inputted to an inverse filtering unit.
Figure 9B:
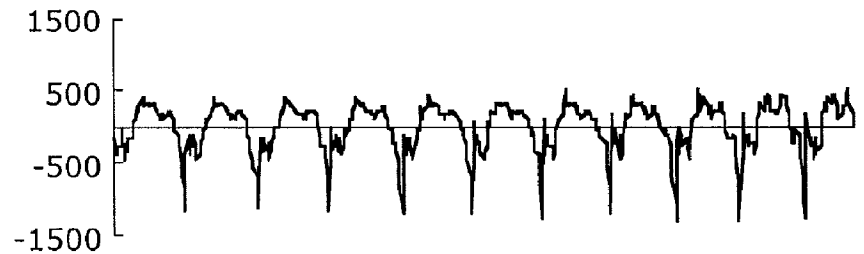
FIG. 9B is a diagram showing an example of a waveform outputted from the inverse filtering unit.

FIG. 9A is a diagram showing an example of a speech waveform inputted to the inverse filtering unit 104. FIG. 9B is a diagram showing an example of a waveform outputted from the inverse filtering unit 104. The inverse filer estimates information regarding the vocal-cord voicing source by removing transfer characteristics of the vocal tract from the speech. Here, obtained is a temporal waveform similar to a differential glottal volume velocity waveform, which is assumed in such models as the Rosenberg-Klatt model. The waveform shown in FIG. 9B has a structure finer than the waveform of the Rosenberg-Klatt model. This is because the Rosenburg-Klatt model is a model using a simple function and therefore cannot represent the temporal fluctuations inherent to each individual vocal cord waveform and other complicated vibrations.

In the present invention, the vocal cord voicing source waveform thus estimated (hereinafter referred to as "voicing source waveform") is modeled in the following method: (1) A glottal closure time for the voicing source waveform is estimated per pitch period. This estimation method includes a method disclosed in Patent Reference: Japanese Patent No. 3576800.

(2) The voicing source waveform is taken per pitch period, centering on the glottal closure time. For the taking, the Hanning window function having nearly twice the length of the pitch period is used.

(3) The waveform, which is taken, is converted into a frequency domain representation. The conversion method is not particularly limited. For example, the waveform is converted into the frequency domain representation by using a discrete Fourier transform (hereinafter, DFT) or a discrete cosine transform.

(4) A phase component is removed from each frequency component in DFT, to thereby generate amplitude spectrum information. For removal of the phase component, the frequency component represented by a complex number is replaced by an absolute value in accordance with the following Equation 4.

[Expression 5]

$$z=\sqrt{x^2+y^2} \qquad \text{(Equation 4)}$$

Here, z represents an absolute value, x represents a real part of the frequency component, and y represents an imaginary part of the frequency component.

(5) The amplitude spectrum information is approximated by one or more functions. Parameters (coefficients) of the above approximate functions are extracted as voicing source information.

The voicing source information is modeled after thus extracted with a time constant equivalent to a pitch period (corresponding to a second time constant). The voicing source waveform includes a number of pitch periods that are continuously present in a time direction. Therefore, the modeling as described above is performed on all of these pitch periods. Since the modeling is performed with respect to each pitch period, the voicing source information is analyzed with a time constant far shorter than the time constant for the vocal tract information.

Next, the method of approximating voicing-source amplitude spectrum information by functions shall be described in detail.

<Method of Approximating Voicing-Source Amplitude Spectrum Information by Functions>

The method of modeling an output waveform outputted from the inverse filtering unit 104 (FIG. 9B) shall be described in detail. The output waveform is a differential glottal volume velocity waveform that is estimated by removing the transfer characteristics of the vocal tract from the speech. Thus, the output waveform has a comparatively simple amplitude spectral envelope from which the formant is removed. This has led the inventors to consider approximating the amplitude spectral envelope by a low-order function so as to achieve an efficient representation of the voicing source information.

In the description below, the output waveform from the inverse filtering unit 104 is referred to as a voicing source, and the amplitude spectrum is simply referred to as a spectrum.

Figure 9C:
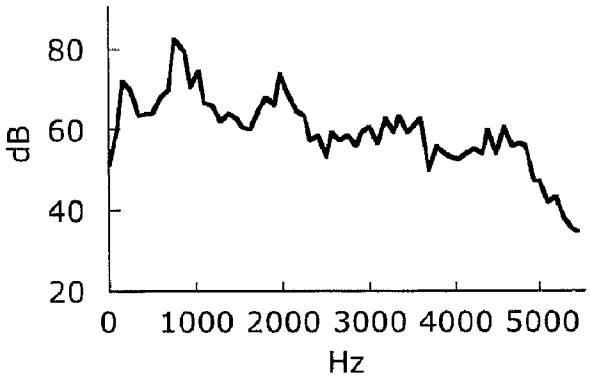
FIG. 9C is a diagram showing an example of a speech spectrum.
Figure 9D:
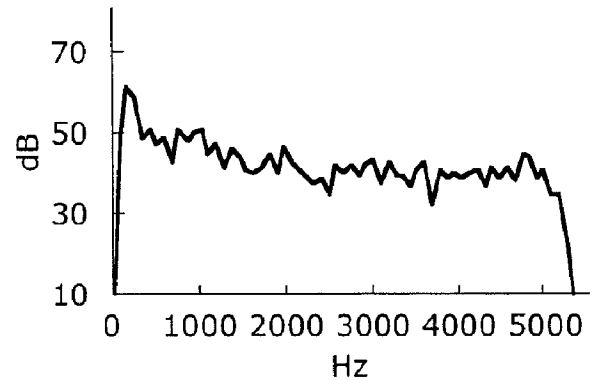
FIG. 9D is a diagram showing an example of a voicing source spectrum.

FIGS. 9C and 9D show examples of spectra of the speech and the voicing source, respectively. In the speech spectrum shown in FIG. 9C, several peaks are present due to formants. However, such peaks are removed from the voicing source spectrum shown in FIG. 9D, which has a decreasing shape from the low frequency area to the high frequency area. This makes it possible to consider that the voicing source spectrum can be approximated by a downward-sloping straight line to a relatively high level. However, the low frequency area tends to deviate from the straight line, and a peak is present around 170 Hz in this example. The peak, which is inherent to the voicing source, is occasionally referred to as a glottal formant in the sense that it is the formant derived from the voicing source.

Figure 10:
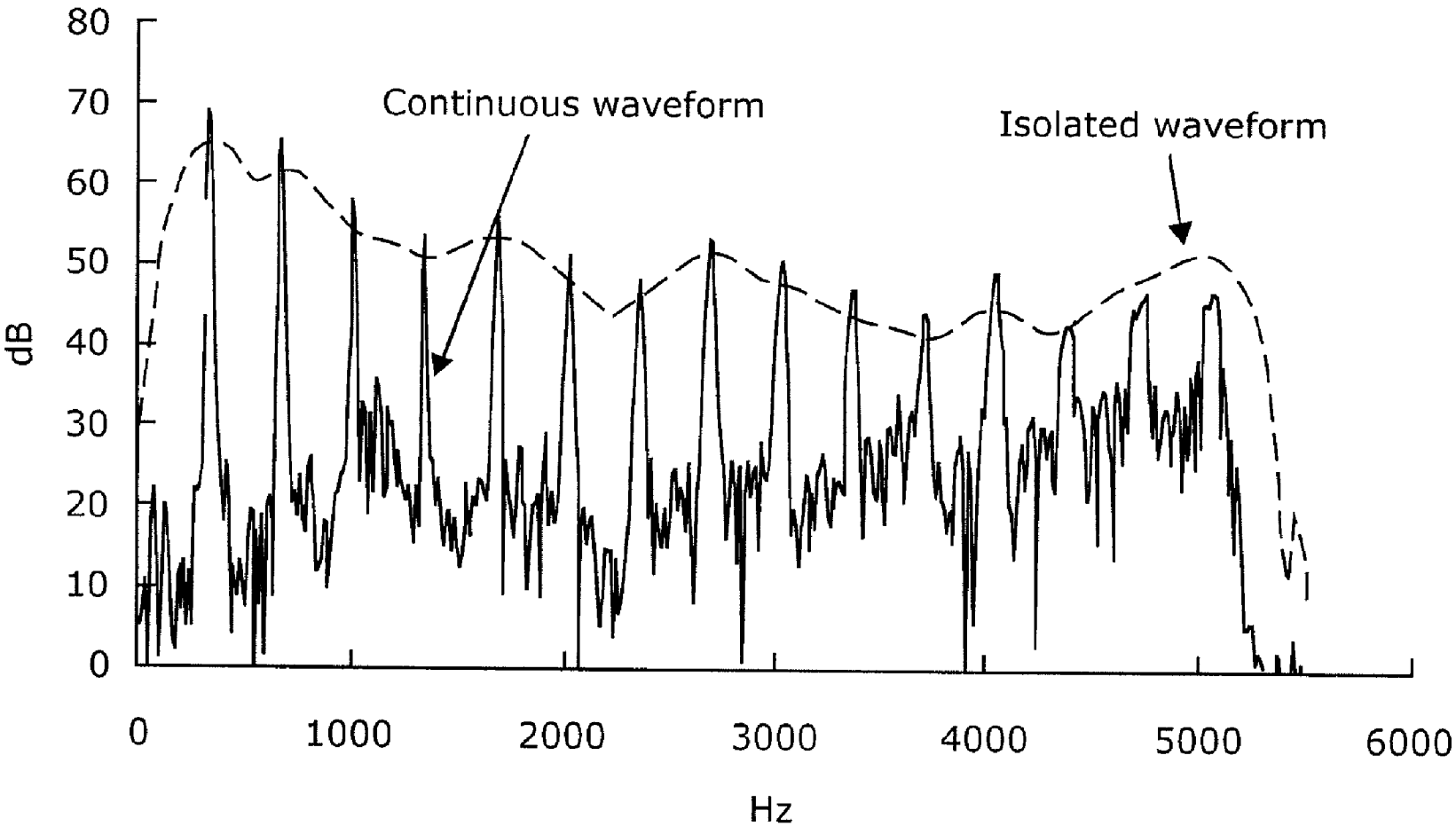
FIG. 10 is a diagram showing a comparison between spectrums of a continuous voicing source waveform and an isolated voicing source waveform.

The output waveform shown in FIG. 9B is a continuous waveform including plural pitch periods. This causes a voicing source spectrum shown in FIG. 9D to have a jagged shape, which represents a harmonic. Whereas, when taking a waveform having about twice the length of the pitch period by using a Hanning window function or the like, the influence of the harmonic is no longer observed. This causes the voicing source spectrum to have a smooth shape. FIG. 10 shows a continuous voicing source waveform spectrum and an isolated waveform of the voicing source which is taken with the Hanning window function. As shown in dashed line in the figure, the voicing source spectrum that is taken with the Hanning window function has an extremely simple shape.

In the present embodiment, it is assumed that the modeling is performed one by one on each voicing source waveform that is taken with the Hanning window having twice the length of the pitch period (hereinafter, referred to as a "voicing source pitch waveform").

Figure 11:
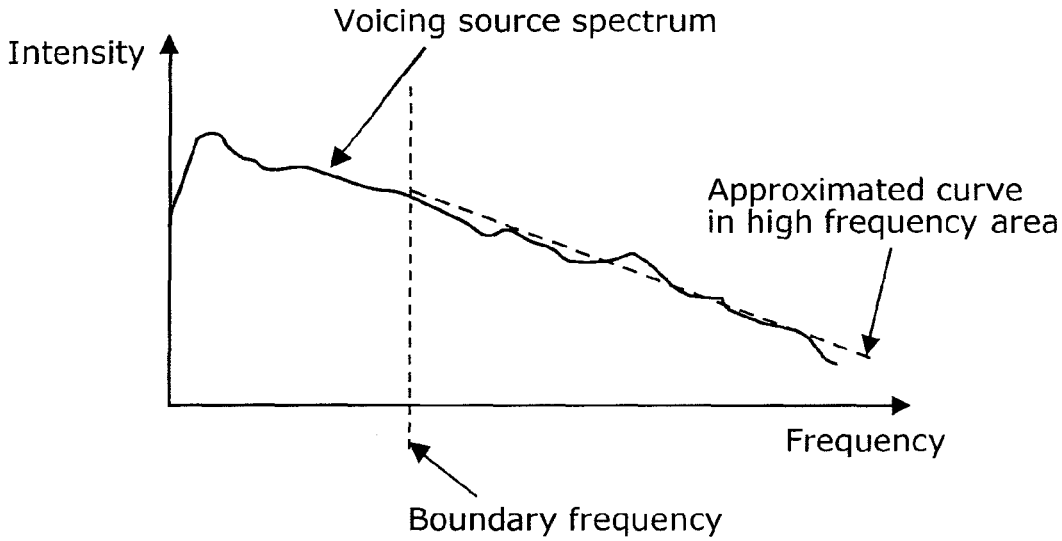
FIG. 11 is a conceptual diagram of a method of approximating a voicing source spectrum in a high frequency area.

Considering auditory characteristics and focusing on the tendency that the higher the frequency is, the lower the frequency resolution is and the less decibel difference affects the perception, the inventors have come to consider, as FIG. 11 shows, using a straight line to approximate the spectrum in the region above a predetermined boundary frequency. Then, the degree of voice quality degradation caused by gradually decreasing the boundary frequency has been measured by a subjective assessment. For the subjective assessment test, five types of speech obtained from analyzing and synthesizing a female speech utterance having a sampling frequency of 11.025 kHz are provided according to boundary frequencies. Then, a degradation mean opinion score (DMOS) test based on the comparison between the five types of speech and the original speech is performed on 19 test subjects (Non-patent Reference: "Method for Subjective Determination of Transmission Quality", ITU-T, Recommendation, P. 800, 1996).

Table 1 shows a five-level scale and evaluation words in the DMOS test.

TABLE 1

| Evaluation scale and words | |
|---|---|
| Level | Evaluation words |
| 5 | Imperceptible |
| 4 | Perceptible, but not annoying |
| 3 | Slightly annoying |

TABLE 1-continued

| Evaluation scale and words | |
|---|---|
| Level | Evaluation words |
| 2 | Annoying |
| 1 | Very annoying |

Figure 12:
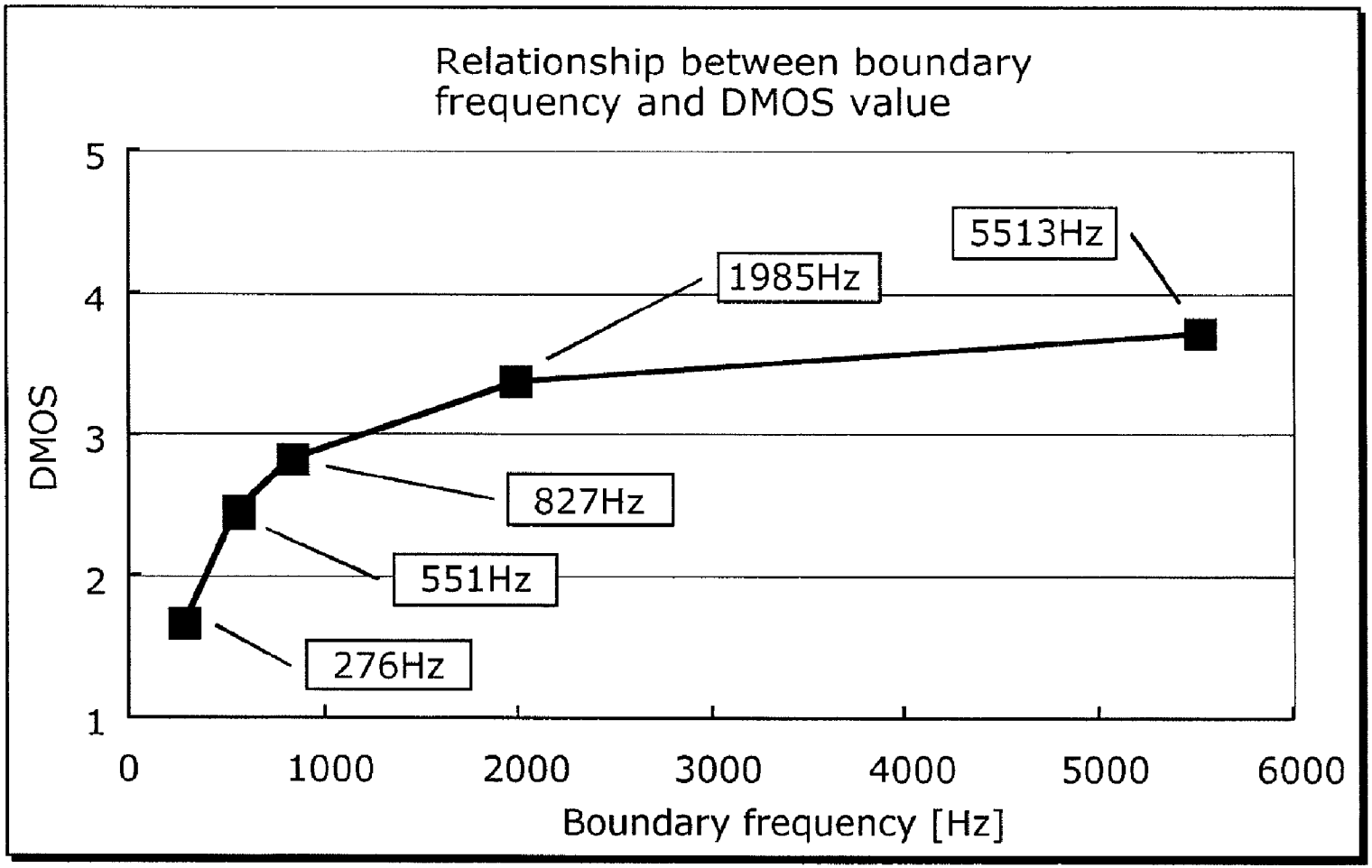
FIG. 12 is a diagram showing a relationship between a boundary frequency and a DMOS value.

FIG. 12 shows the test result. The result has clarified that: the sound quality of the speech used for this test hardly degraded even when the boundary frequency was lowered down to around 800 Hz (the level of Slightly annoying), and the sound quality rapidly degraded at around 500 Hz (the level of Annoying). The inventors consider that the degradation is caused by the influence of the peak due to the glottal formant upon the straight-line approximation. The boundary frequency at this point is referred to as a lower limit of boundary frequency.

Figure 13:
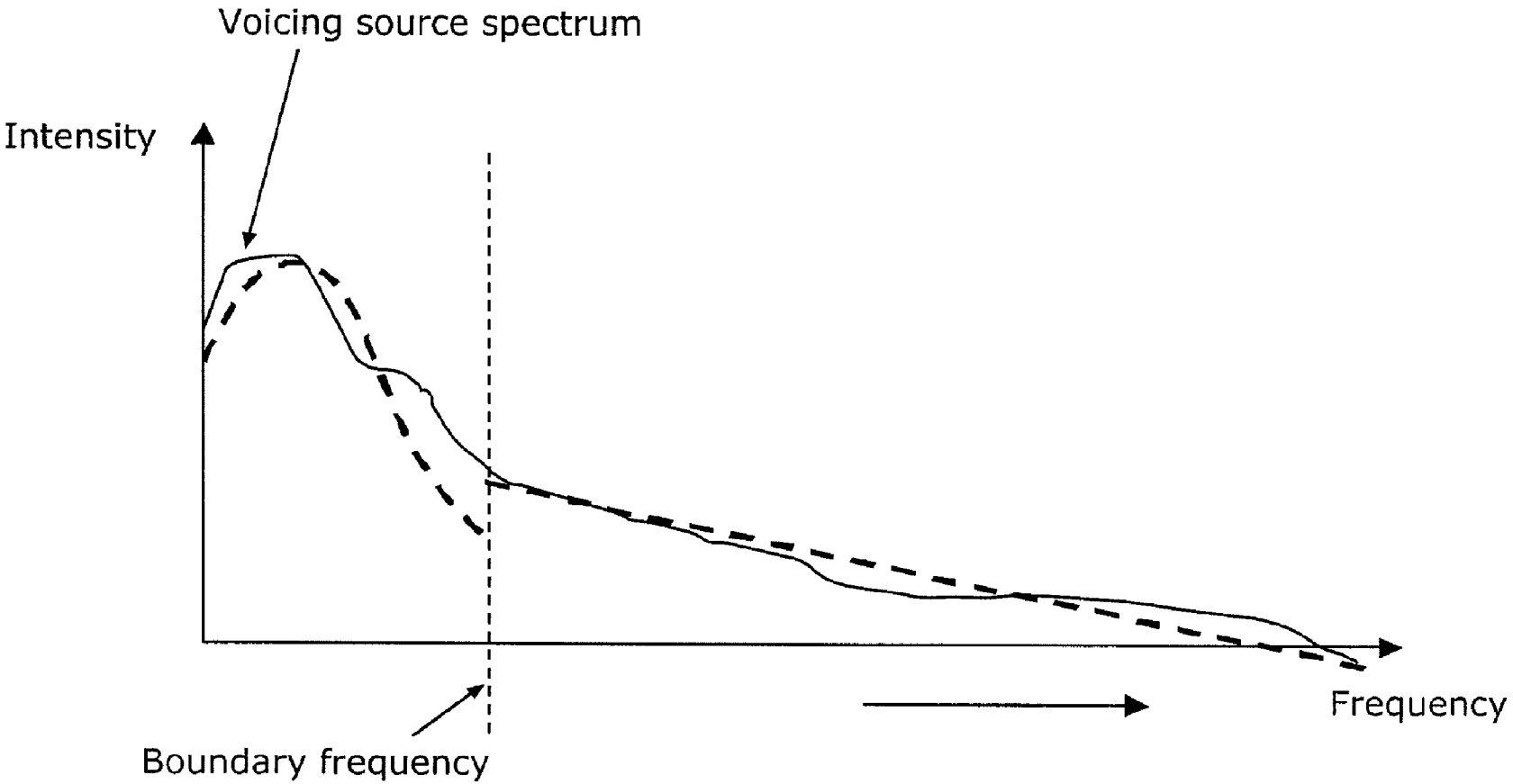
FIG. 13 is a conceptual diagram of a method of approximating a voicing source spectrum in a low frequency area.

Furthermore, the inventors have attempted, as FIG. 13 shows, a straight-line approximation of the spectrum in the domain above the boundary frequency (800 Hz and above), and an approximation of the spectrum in the domain below the boundary frequency (800 Hz and below) by using another function. In the domain below the boundary frequency, a peak caused by the glottal formant is present. Therefore, it is difficult to apply the straight-line approximation, and thus it is necessary to use a function of second or higher order. In a preliminary test, in an approximation using a quadratic function, a phenomenon was observed in which energy in the low frequency area was decreased. A possible cause of this was that the magnitude of the fundamental frequency component was not sufficiently represented, thus causing attenuation. Then, a test for incrementing the order of an approximate function was conducted to clarify that energy decrease in the low frequency area was generally eliminated using a biquadratic function.

Figure 14:
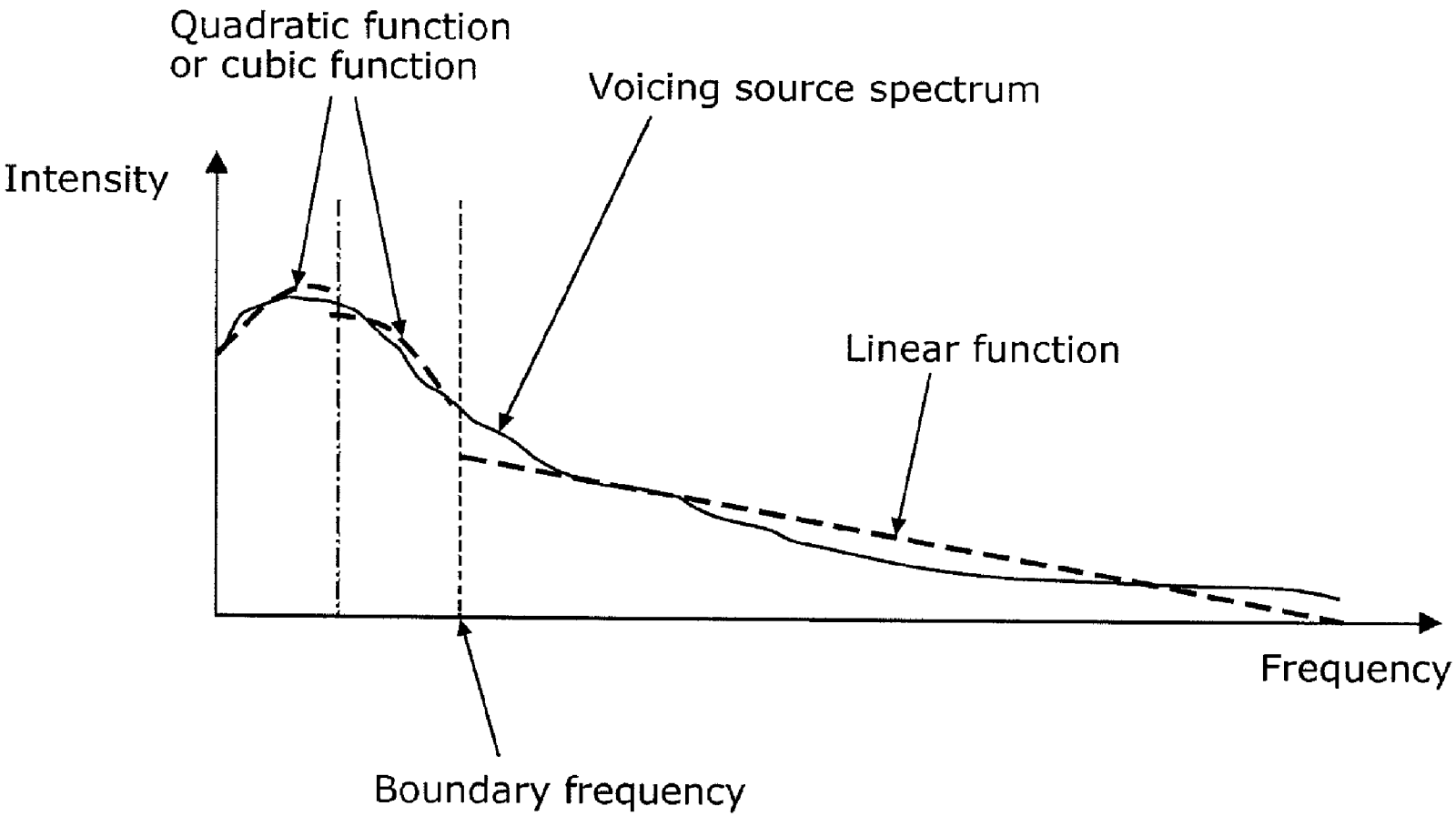
FIG. 14 is a conceptual diagram of a method of approximating a voicing source spectrum in a low frequency area.

However, incrementing the order means increasing sensitivity to the quantization of the coefficient, and thereby increasing difficulty in implementation to the hardware. Therefore, as FIG. 14 shows as an alternative technique, a test was conducted in which the low frequency area is further divided into two parts, in each of which an approximation was performed using a lower-order function. An attempted method was to assign a cubic function to a first half including a glottal-formant peak, and a quadratic function to a second half. Furthermore, another technique was attempted in which a quadratic function is consistently assigned to both of these parts in order to further reduce the information.

Figure 15A:
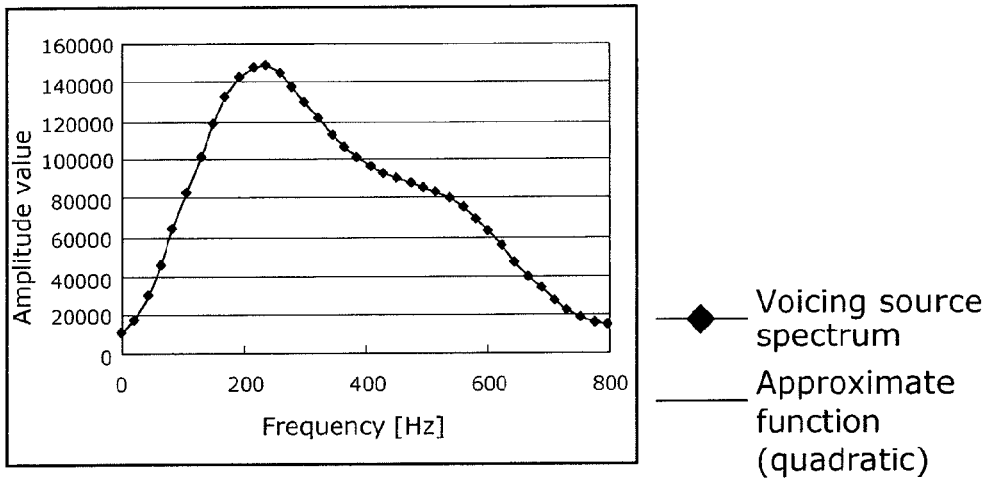
FIG. 15A is a diagram showing a voicing source spectrum in a low frequency area (800 Hz and below) having one peak.
Figure 15B:
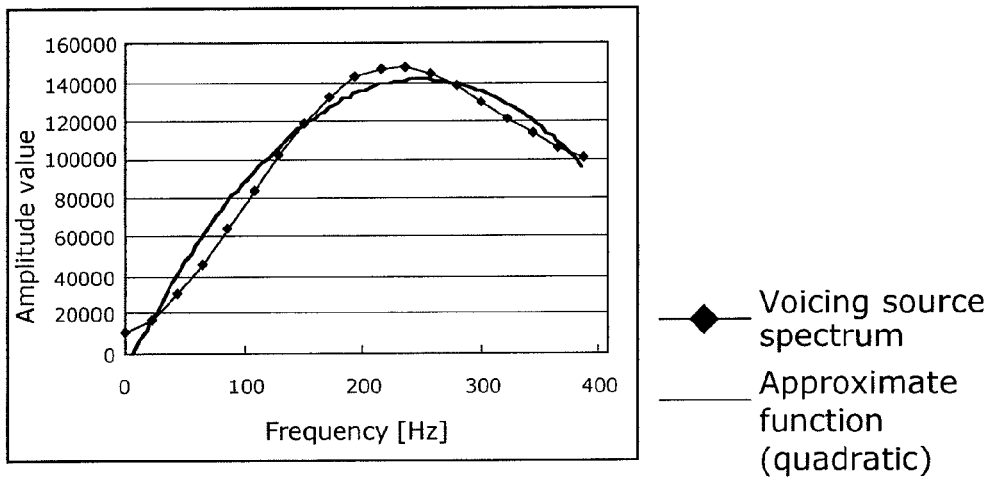
FIG. 15B is a diagram showing a spectrum on the left when the voicing source spectrum shown in FIG. 15A is divided into two parts, and an approximated curve thereof by a quadratic function.
Figure 15C:
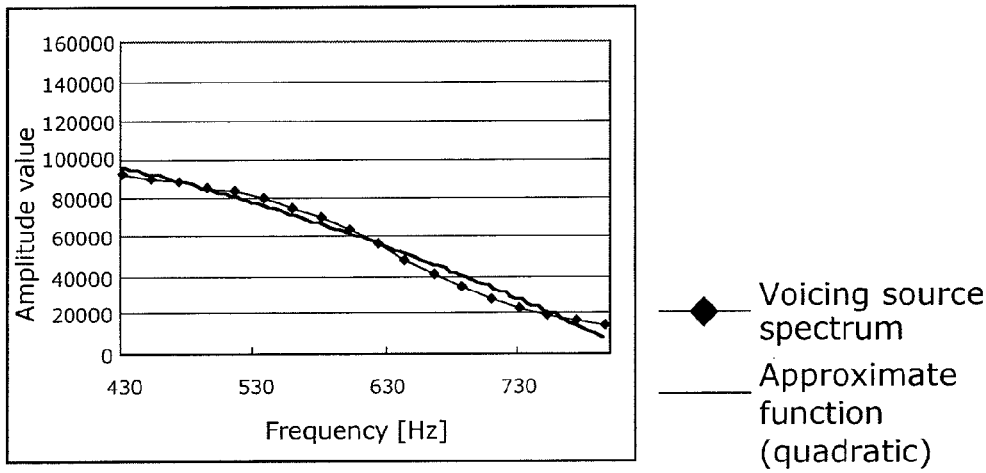
FIG. 15C is a diagram showing a spectrum on the right when the voicing source spectrum shown in FIG. 15A is divided into two parts, and an approximated curve thereof by a quadratic function.
Figure 16A:
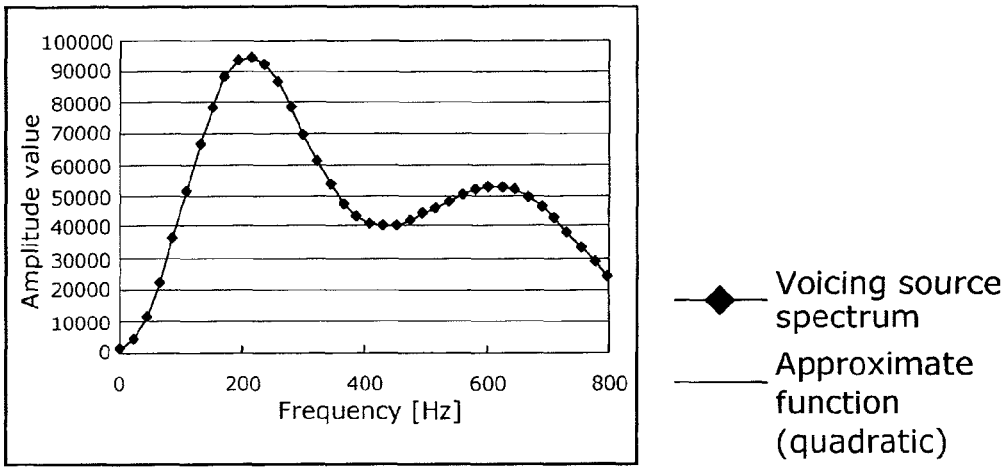
FIG. 16A is a diagram showing a voicing source spectrum having two peaks in a low frequency area (800 Hz and below).
Figure 16B:
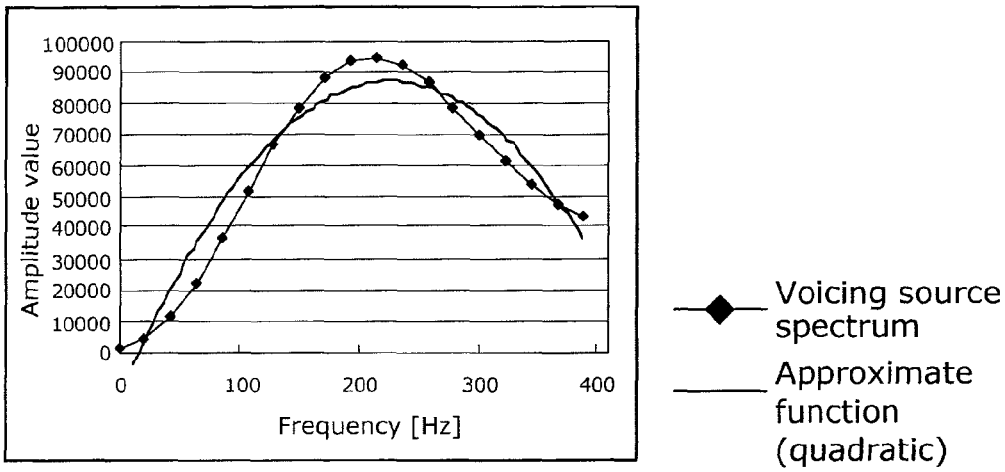
FIG. 16B is a diagram showing a spectrum on the left when the voicing source spectrum shown in FIG. 16A is divided into two parts, and an approximated curve thereof by a quadratic function.
Figure 16C:
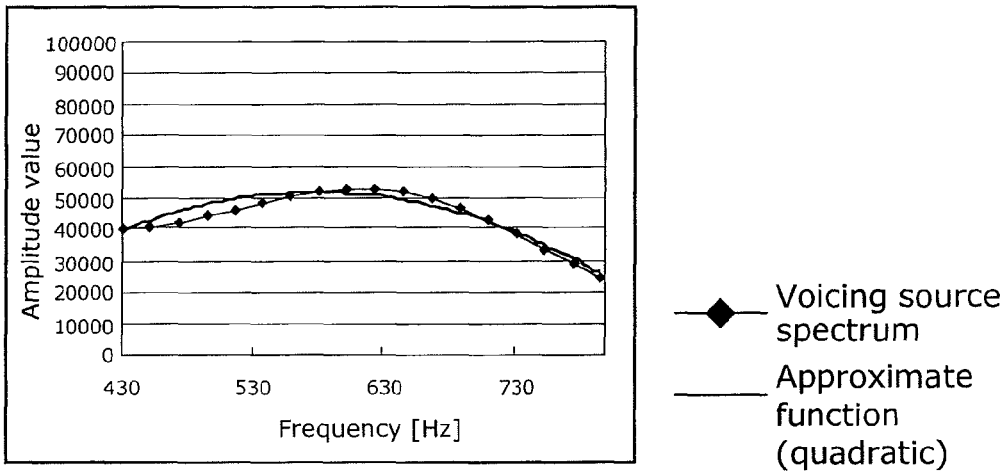
FIG. 16C is a diagram showing a spectrum on the right when the voicing source spectrum shown in FIG. 16A is divided into two parts, and an approximated curve thereof by a quadratic function.

This test has proved that sufficient sound quality can be obtained by assigning a quadratic function to both parts. FIGS. 15A to 15C show a process of approximating the voicing source spectrum in the low frequency area by using two quadratic functions. FIG. 15A shows a voicing source spectrum in the low frequency area (800 Hz and below), and FIG. 15B shows a spectrum in a left half of the low frequency area divided into two parts and a curve approximated by a quadratic function. FIG. 15C shows, likewise, a spectrum in a right half and an approximated curve. These figures show that the peak caused by the glottal formant is appropriately approximated. Furthermore, it has been clarified that this method allows a highly accurate approximation even when the vocal tract does not match an all-pole model as in the case of nasal sounds. Even in the case of two peaks appearing in the voicing source spectrum as shown in FIGS. 16A to 16C, the voicing source spectrum is successfully approximated with high accuracy by using two quadratic functions. FIG.

16A shows a voicing source spectrum in the low frequency area (800 Hz and below), and FIG. 16B shows a spectrum in a left half of the low frequency area divided into two parts and a curve approximated using a quadratic function. FIG. 16C shows, likewise, a spectrum in a right half and an approximated curve.

Thus, it has been clarified that it is effective to apply a straight-line approximation to a domain having a frequency above the boundary frequency, and to apply a quadratic function to each of the two parts of the domain having a frequency below the boundary frequency and divided in half.

Meanwhile, it is clarified that the lower limit of boundary frequency described above is different from speaker to speaker. Thus far, an example of using speech of a female speaker has been described, but when the same frequency was applied to speech of a male speaker, a phenomenon was observed in which energy in the low frequency area decreased. A possible cause of this is a low fundamental frequency component of the male voice, which results in a low glottal formant position (glottal formant frequency). In fact, an optimal point is found down below the boundary frequency.

Based on these results and with an understanding that the glottal formant position fluctuates in continuous speech even when the speech is uttered by the same single speaker, the inventors have conceived a method of dynamically setting the boundary frequency according to the voicing source spectrum. The method is to previously store, in a table, plural boundary frequencies (276 Hz, 551 Hz, 827 Hz, 1103 Hz, 1378 Hz, and 1654 Hz) as boundary frequency candidates. The spectrum is approximated by sequentially selecting these boundary frequency candidates, so as to select a boundary frequency having a minimum square error.

Figure 17:
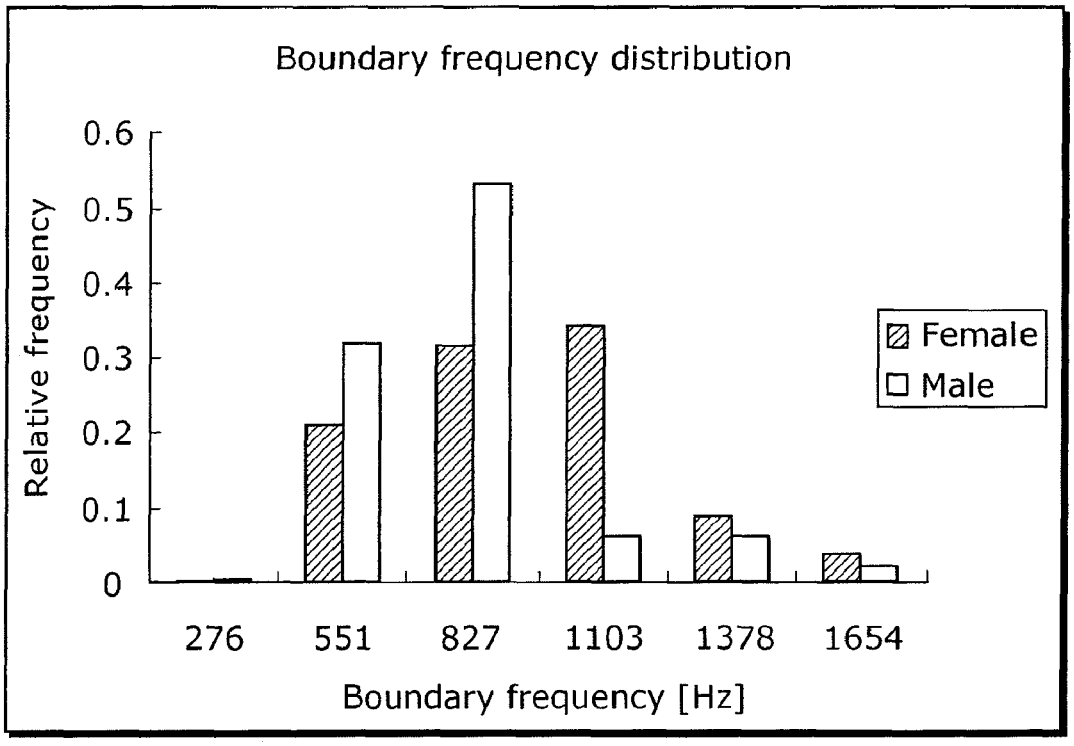
FIG. 17 is a diagram showing a distribution of a boundary frequency.

FIG. 17 shows a relative frequency distribution of optimal boundary frequencies that are set in the manner described above. FIG. 17 shows a distribution in the case where speech having the same content and uttered individually by a male speaker and a female speaker is analyzed, and where the boundary frequency is dynamically set by the method described above. For the male speaker, the peak in the distribution is seen at a lower frequency than for the female speaker. In other words, it can be said that such dynamic setting of the boundary frequency affects adaptively the speech to be analyzed and produces an effect of enhancing accuracy in the approximation of the voicing source spectrum.

Thus, the voicing source modeling unit 105 analyzes an inverse filter waveform on a per-pitch period basis, and stores: linear-function coefficients (a1, b1) for high frequency area; quadratic-function coefficients for area A in the low frequency area (a2, b2, c2); quadratic-function coefficients for area B (a3, b3, c3); information on the boundary frequency Fc; and, additionally, temporal and positional information on the pitch period.

Note that here the magnitude of the DFT frequency component is used as a voicing source spectrum, but normally the magnitude of each DFT frequency component is logarithmically converted when displaying the amplitude spectrum. Therefore, it is naturally possible to perform the approximation using functions after such processing.

<Conversion Ratio Input Unit 110>

The conversion ratio input unit 110 inputs, as a conversion ratio, the degree to which the inputted speech should be converted into the target speech information held by the target speech information holding unit 107.

<Filter Transformation Unit 106>

The filter transformation unit 106 performs transformation (conversion) of the PARCOR coefficients smoothed by the filter smoothing unit 103.

Although the unit of conversion is not particularly limited, a case of the conversion in units of phoneme shall be described, for example. First, the filter transformation unit 106 obtains, from the target speech information holding unit 107, a target PARCOR coefficient corresponding to a phoneme to be converted. For example, such a target PARCOR coefficient is prepared for each phoneme category.

The filter transformation unit 106 transforms an inputted PARCOR coefficient, based on the information on the target PARCOR coefficient and the conversion ratio inputted by the conversion ratio input unit 110. The inputted PARCOR coefficient is specifically a polynomial used for the smoothing by the filter smoothing unit 103.

First, the conversion source parameter (inputted PARCOR coefficient) is represented by Equation 5, and thus the filter transformation unit 106 calculates a coefficient $a_i$ of the polynomial. This coefficient $a_i$, when used for generating a PARCOR coefficient, allows generation of a smooth PARCOR coefficient.

[Expression 6]

$$\hat{y}_a = \sum_{i=0}^{p} a_i x^i \qquad \text{(Equation 5)}$$

Next, the filter transformation unit 106 obtains a target PARCOR coefficient from the target speech information holding unit 107. The filter transformation unit 106 calculates a coefficient $b_i$ of polynomial by approximating the obtained PARCOR coefficient by using the polynomial represented by Equation 6. Note that the coefficient $b_i$ after the approximation using the polynomial may be previously stored in the target speech information holding unit 107.

[Expression 7]

$$\hat{y}_b = \sum_{i=0}^{p} b_i x^i \qquad \text{(Equation 6)}$$

Next, the filter transformation unit 106 calculates a coefficient $c_i$ of polynomial for the converted PARCOR coefficient in accordance with Equation 7, by using a parameter to be converted $a_i$, a target parameter $b_i$, and a conversion ratio r.

[Expression 8]

$$c_i = a_i + (b_i - a_i) \times r \qquad \text{(Equation 7)}$$

Normally, the conversion ratio r is designated within a range of $0 \leqq r \leqq 1$. However, even in the case of the conversion ratio r exceeding the range, it is possible to convert the parameter in accordance with Equation 7. In the case of the conversion ratio r exceeding 1, the difference between the parameter to be converted ($a_i$) and the target vowel vocal tract information ($b_i$) is further emphasized in the conversion. On the other hand, in the case of the conversion ratio r assuming a negative value, the difference between the parameter to be converted ($a_i$) and the target vowel vocal tract information ($b_i$) is further emphasized in a reverse direction in the conversion.

The filter transformation unit 106 calculates the filter coefficient after the conversion in accordance with Equation 8, by using the calculated coefficient $c_i$ of polynomial after the conversion.

[Expression 9]

$$\hat{y}_c = \sum_{i=0}^{p} c_i x^i \quad \text{(Equation 8)}$$

The above conversion processing, when performed in each dimension of the PARCOR coefficient, allows the conversion into the target PARCOR coefficient at a designated conversion ratio.

Figure 18:
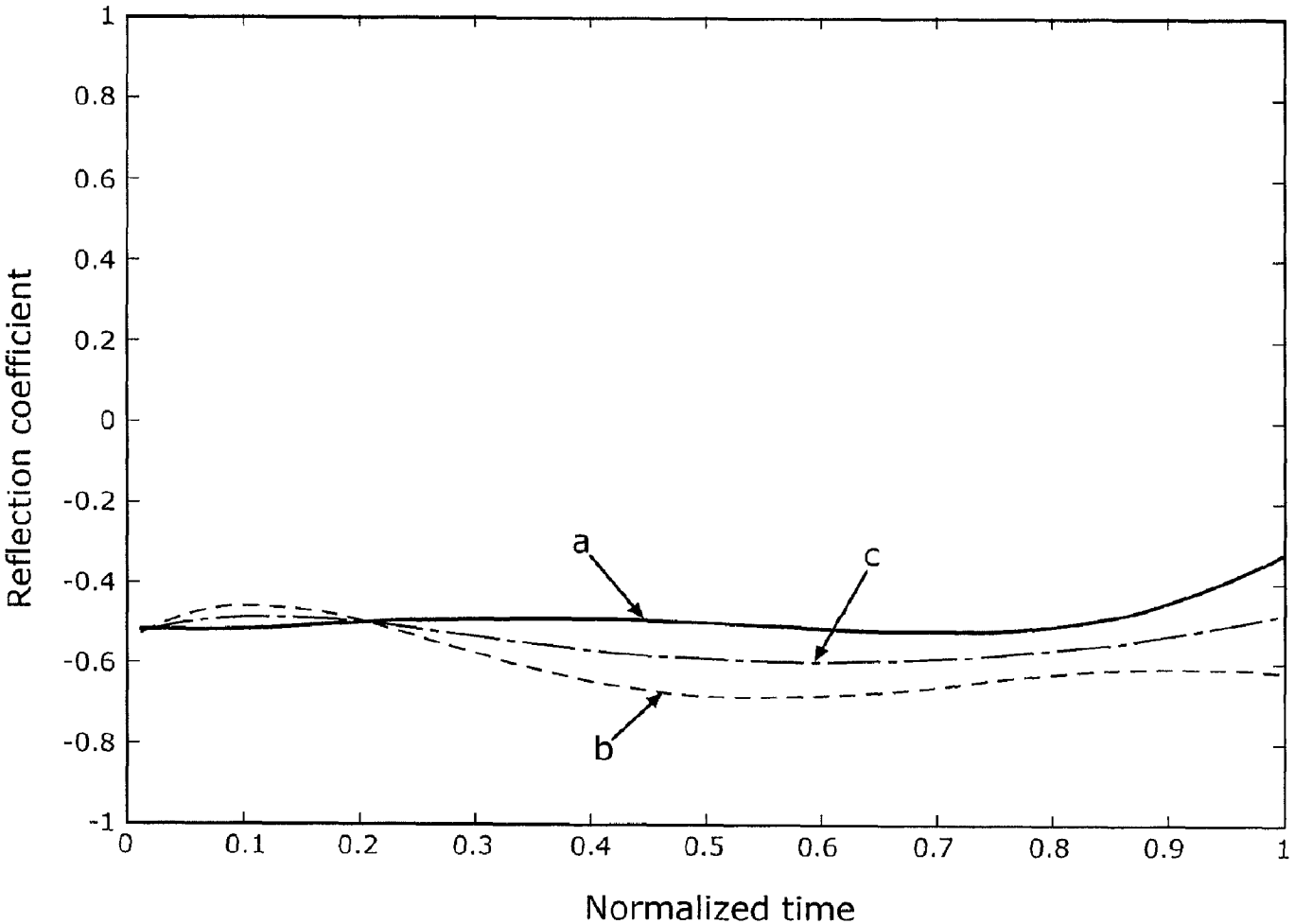
FIG. 18 is a diagram showing a result of interpolating a PARCOR coefficient approximated by a polynomial function.

FIG. 18 shows an example in which the above conversion is actually performed on the vowel /a/. In the figure, a horizontal axis indicates normalized time, and a vertical axis indicates a first-order PARCOR coefficient. A curve a in the figure shows the change of coefficient for /a/ uttered by a male speaker, which represents speech to be converted. The normalized time is the length of duration of the vowel section, and is a point in time assuming values between 0 and 1 after normalized according to the length of duration of the vowel section. This is the processing for aligning temporal axes when the vowel duration of the speech to be converted and the duration of the target vowel information are different. Likewise, a curve b shows the change of coefficient for /a/ uttered by a female speaker, which represents a target vowel. A curve c shows change of coefficient when transforming, by the conversion method described above, the coefficient for the male speaker into the coefficient for the female speaker at a conversion ratio of 0.5. As can be seen from the figure, the curve c is located approximately midway between the curves a and b. This shows that PARCOR coefficients between the speakers are properly interpolated according to the transformation method described above.

On the phoneme boundary, as in the case of the filter smoothing unit 103, an appropriate transitional section is provided for the interpolation so as to prevent discontinuity of the PARCOR coefficient values.

Figure 19A:
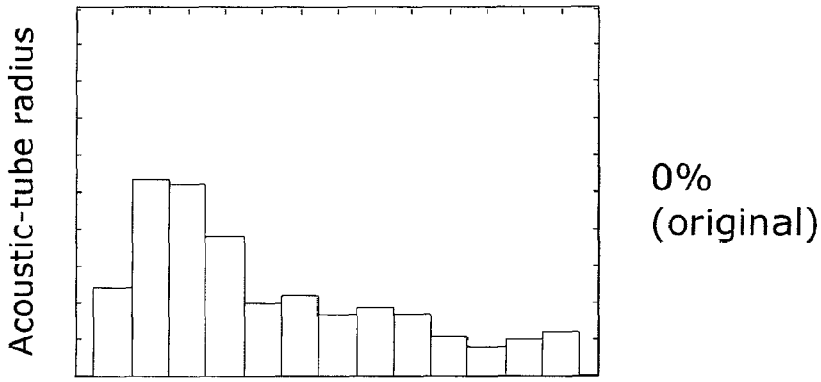
FIG. 19A is a diagram showing an example of a vocal tract cross-sectional area at a center time of source speech /a/, which is uttered by a male speaker.
Figure 19B:
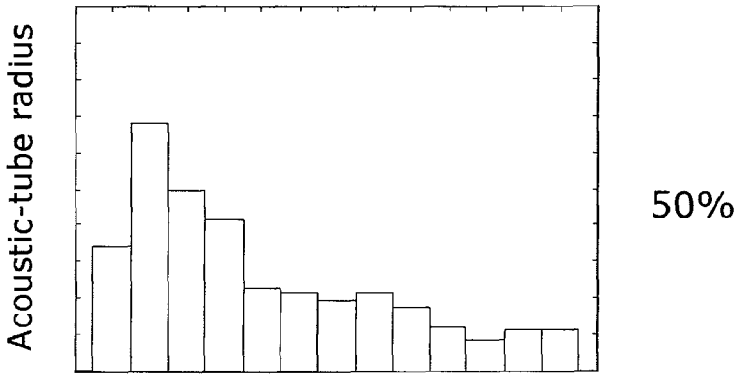
FIG. 19B is a diagram showing an example of a vocal tract cross-sectional area at a center time of speech, which corresponds to a PARCOR coefficient after converting a source PARCOR coefficient at a conversion ratio of 0.5.
Figure 19C:
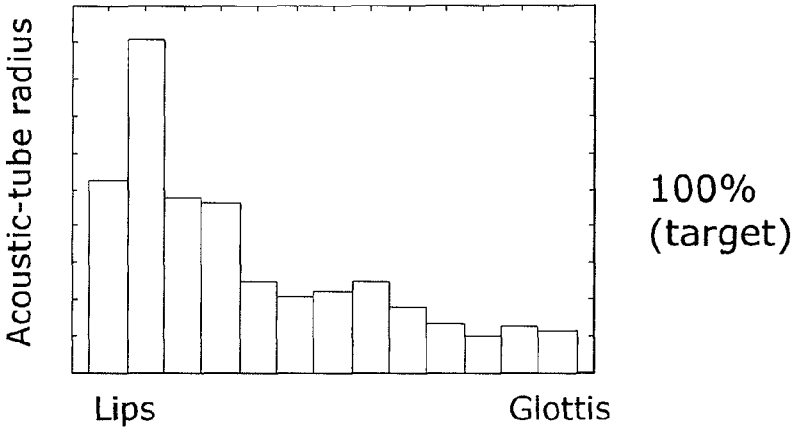
FIG. 19C is a diagram showing an example of a vocal tract cross-sectional area at a center time of target speech /a/, which is uttered by a female speaker.

In order to recognize the appropriateness of such interpolation in PARCOR coefficients, FIGS. 19A to 19C show a process in which the vocal tract cross-sectional area is interpolated after converting the PARCOR coefficient into a vocal tract area function in accordance with Equation 9.

[Expression 10]

$$\frac{A_n}{A_{n+1}} = \frac{1-k_n}{1+k_n} \quad \text{(Equation 9)}$$

Here, the left side represents a comparison of vocal-tract cross-sectional areas in section n and section n+1. $K_n$ represents an $n^{th}$ and an $n+1^{th}$ PARCOR coefficients on the vocal tract boundary.

FIG. 19A shows vocal tract cross-sectional area at a center time of the male-speaker utterance /a/, which is the source of the conversion. FIG. 19C shows vocal tract cross-sectional area at a center time of the female-speaker utterance /a/, which is the target. FIG. 19B shows vocal tract cross-sectional area at the center time of the speech, which corresponds to the PARCOR coefficient obtained after the source PARCOR coefficient is converted at a conversion ratio of 0.5. In FIGS. 19A to 19C, a horizontal axis indicates the position of the vocal tract, with a left end representing the lips and the right end representing the glottis. The vertical axis corresponds to a radius of the vocal tract cross section.

As clearly shown by FIGS. 19A to 19C, the vocal tract cross-sectional area for the speech, which has been interpolated at a conversion ratio of 0.5, represents a shape of the vocal tract that is intermediate between the male and female speakers. Accordingly, it is clear that intermediate PARCOR coefficients between the male and female speakers are properly interpolated within a physical feature space of the vocal tract.

In addition, since the vocal tract information is smoothed in a time direction through polynomial approximation, it is possible to convert the vocal tract information through extremely simplified processing.

<Target Speech Information Holding Unit 107>

The target speech information holding unit 107 holds the vocal tract information regarding the target voice quality. For the vocal tract information, a time sequence of a target PARCOR coefficient is included in at least each phonological category. In the case of holding the time sequence of a PARCOR coefficient in each category, the filter transformation unit 106 obtains a time sequence of the PARCOR coefficient corresponding to the category. This allows the filter transformation unit 106 to obtain a function used for the approximation of the target PARCOR coefficient.

In addition, in the case where the target speech information holding unit 107 holds plural PARCOR coefficient time sequences for each category, the filter transformation unit 106 may select a PARCOR coefficient time sequence most adaptable for the source PARCOR parameter. The selection method is not particularly limited, but the selection may be performed using, for example, the function selection method described in Patent Reference: Japanese Patent No. 4025355.

In addition, the target speech information holding unit 107 further holds voicing source information as target speech information. The voicing source information includes, for example, an average fundamental frequency, an average aperiodic component boundary frequency, and an average voiced voicing source amplification of the target speech.

<Voicing Source Transformation Unit 108>

The voicing source transformation unit 108 transforms the voicing source parameter modeled by the voicing source modeling unit 105, using information related to the voicing source from among the target speech information held by the target speech information holding unit 107.

The transformation method is not particularly limited. For example, the method may be realized by conversion processing for converting an average value of the fundamental frequency of the modeled voicing source parameter, the aperiodic component boundary frequency, or the voiced voicing source amplification into the information held by the target speech information holding unit 107 in accordance with the conversion ratio inputted by the conversion ratio input unit 110.

<Synthesis Unit 109>

The synthesis unit 109 drives a filter based on the PARCOR coefficient transformed by the filter transformation unit 106, using the voicing source based on the voicing source parameter transformed by the voicing source transformation unit 108, so as to generate synthesized speech. This, however, does not limit a specific generation unit. An example of the method of generating a voicing source waveform shall be described with reference to FIG. 20.

Figure 20:
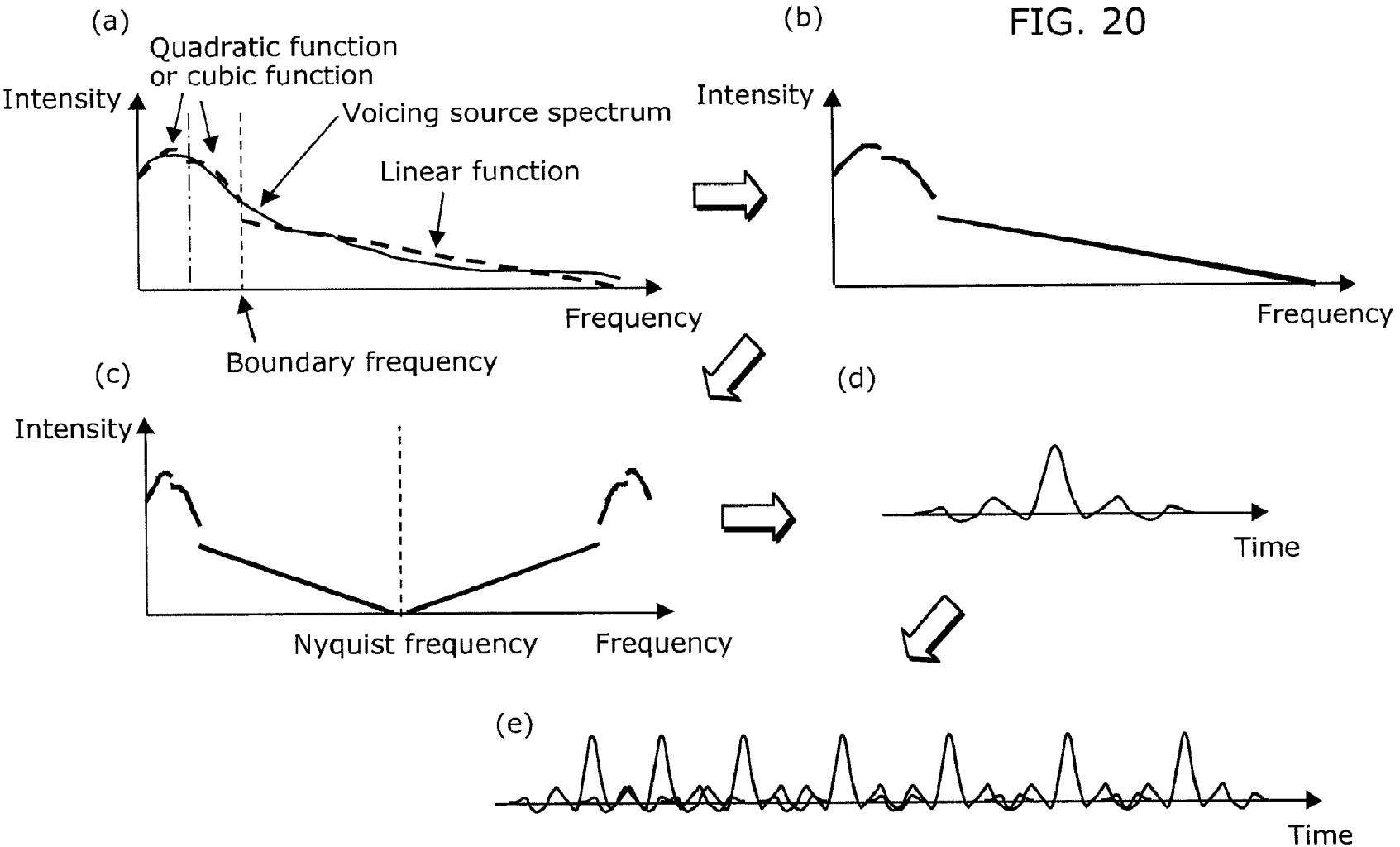
FIG. 20 is a diagram describing an outline of generating a voicing source waveform.

FIG. 20(*a*) shows that the voicing source parameter, which is modeled by the method described above, is obtained through approximation of the amplitude spectrum. That is, the frequency band below the boundary frequency is divided into two parts, the voicing source spectrum in each half of the divided frequency band is approximated using a quadratic function, and the voicing source spectrum in the frequency band above the boundary frequency is approximated using a linear function. The synthesis unit 109 restores the amplitude spectrum based on the information (the coefficients of the respective functions). As a result, a simplified amplitude spectrum as shown in FIG. 20(*b*) is obtained. The synthesis unit 109 creates a symmetrical amplitude spectrum by folding back this amplitude spectrum at the boundary of Nyquist frequency (half the sampling frequency) as shown in FIG. 20(*c*).

The synthesis unit 109 converts the amplitude spectrum thus restored in the frequency domain into a temporal waveform by applying the inverse discrete Fourier transform (IDFT). The waveform thus restored is a bilaterally symmetrical waveform having a length of one pitch period as shown in FIG. 20(*d*). Accordingly, the synthesis unit 109, as shown in FIG. 20(*e*), generates a continuous voicing source waveform by overlapping such waveforms so as to obtain a desired pitch period.

Figure 21:
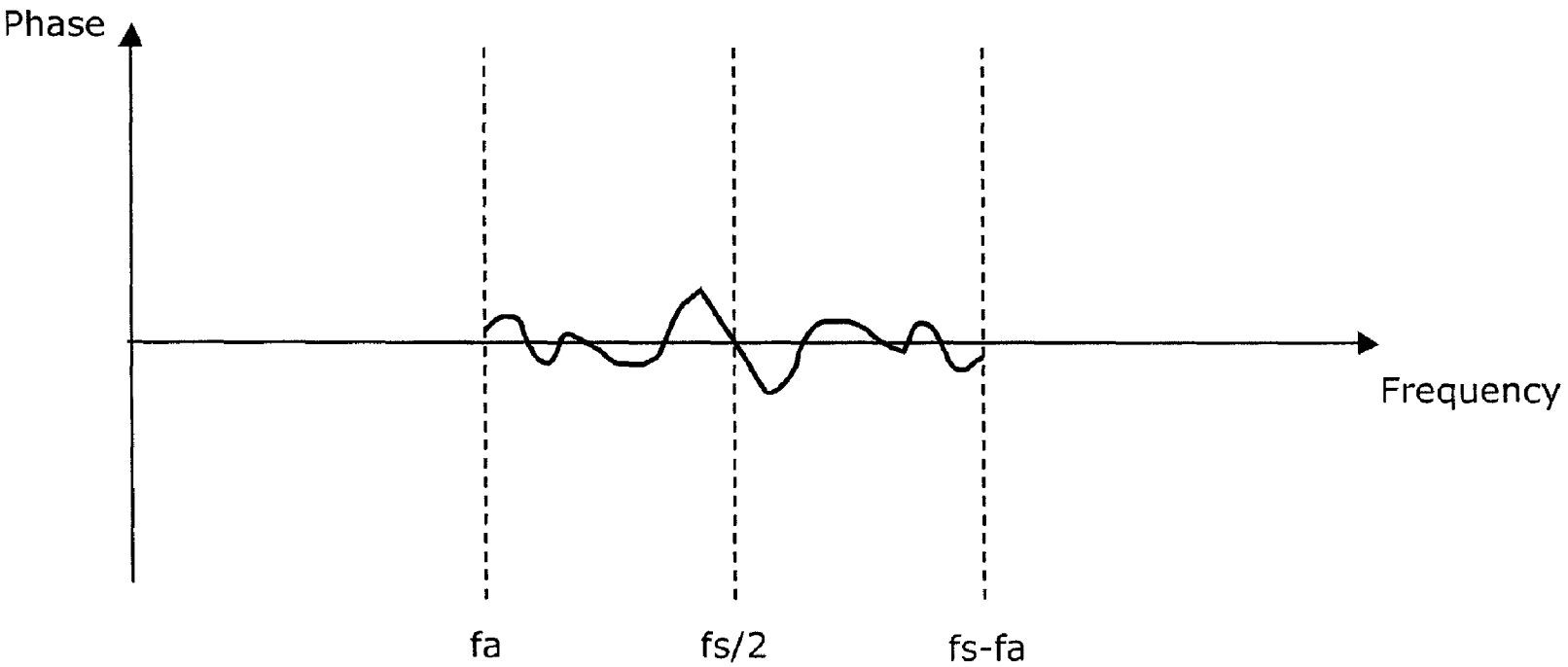
FIG. 21 is a diagram showing an example of phase characteristics added to a voicing source spectrum.

In FIG. 20(*c*), the symmetrical amplitude spectrum does not include phase information. Whereas, as shown in FIG. 20(*e*), it is possible to add phase information by overlapping the restored waveforms. This makes it possible to add breathiness or softness to the voiced source by adding, as shown in FIG. 21, a random phase to the frequency band above the aperiodic component boundary frequency. Assuming that the phase information to be added is point-symmetric with respect to the Nyquist frequency, the results of the IDFT is a temporal waveform having no imaginary part.

Figure 22:
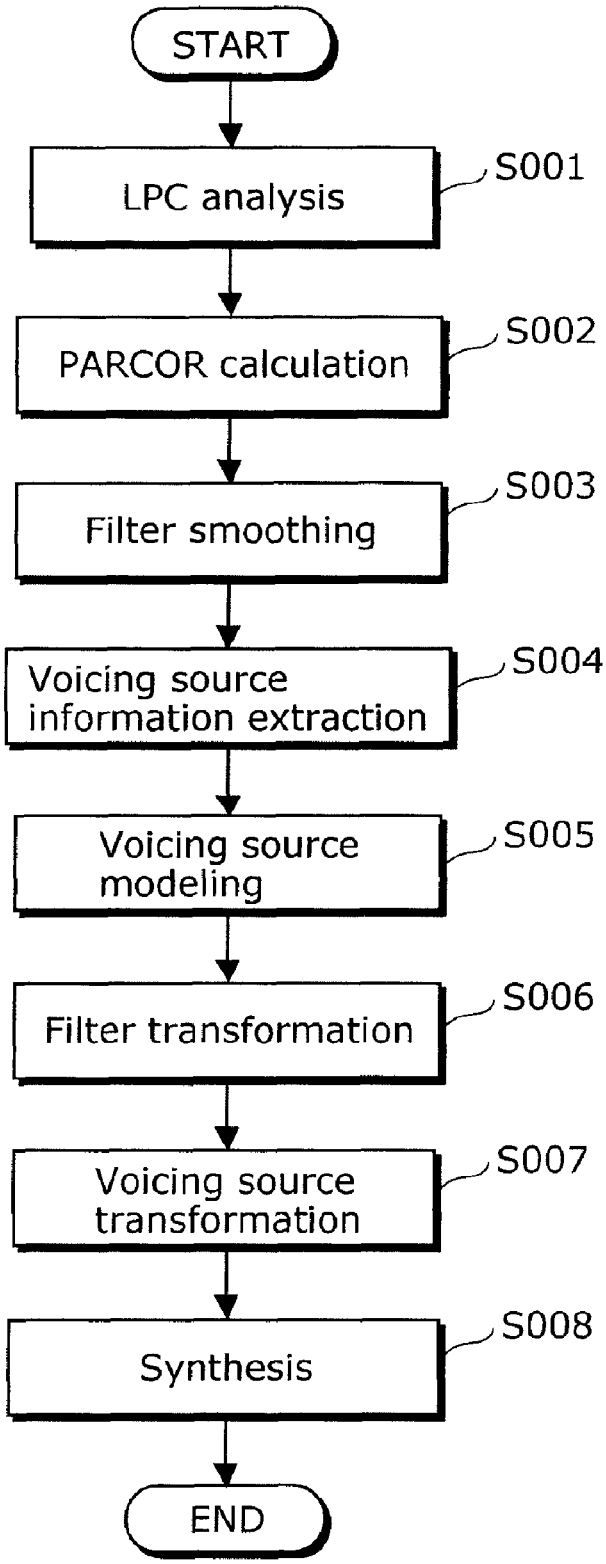
FIG. 22 is a flowchart showing a flow of an operation of a voice quality conversion apparatus in the first embodiment of the present invention.

Next, the operation of the voice quality conversion apparatus shall be described with reference to the flowchart shown in FIG. 22.

The LPC analysis unit 101 performs an LPC analysis on inputted speech so as to calculate a linear predictive coefficient $a_i$ (step S001).

The PARCOR calculating unit 102 calculates a PARCOR coefficient $k_i$ from the linear predictive coefficient $a_i$ calculated in step S001 (step S002).

The filter smoothing unit 103 smoothes, in a time direction, parameter values in respective dimensions of the PARCOR coefficient $k_i$ calculated in step S002 (step S003). This smoothing allows removal of temporal fluctuation components of the voicing source information that remain in the vocal tract information. The description shall be continued below based on the assumption that the smoothing is performed through polynomial approximation at this point in time.

The inverse filtering unit 104 generates an inverse filter representing inverse characteristics of the vocal tract information, using vocal tract information from which the temporal fluctuations of the voicing source information are removed after the smoothing in a time direction performed in step S003. The inverse filtering unit 104 performs inverse filtering on the inputted speech, using the generated inverse filter (step S004). This makes it possible to obtain voicing source information including the temporal fluctuations of the voicing source, which is conventionally included in the vocal tract information.

The voicing source modeling unit 105 performs modeling on the voicing source information obtained in step S004 (step S005).

The filter transformation unit 106 transforms the vocal tract information approximated using the polynomial function calculated in step S003, in accordance with the conversion ratio separately inputted from the outside, so that the voicing source information is approximated to the target voicing source information (step S006).

The voicing source transformation unit 108 transforms a voicing model parameter parameterized into a model in step S005 (step S007).

The synthesis unit 109 generates synthesized speech based on the vocal tract information calculated in step S006 and the voicing source information calculated in step S007 (step S008). Note that the processing of step S006 may be performed immediately after the performance of the processing of step S003.

The processing described above makes it possible to accurately separate, with respect to the inputted speech, the voicing source information and the vocal tract information. Furthermore, when converting voice quality by transforming such accurately-separated vocal tract information and voicing source information, it is possible to perform voice quality conversion resulting in less degradation of the sound quality.

(Effects)

Conventionally, as FIGS. 5A to 5D show, vocal tract information, which is extracted by such a vocal tract information extracting method as LPC analysis or PARCOR analysis, includes fluctuations having a shorter time constant than that of the inherent temporal fluctuations of the vocal tract information. However, FIGS. 6A to 6D show that with the configuration as described thus far, it is possible, by smoothing the vocal tract information in a time direction, to remove a component that is not a part of the inherent temporal fluctuations of the vocal tract information.

Furthermore, it is possible to obtain voicing source information which includes information that is conventionally removed, by performing inverse filtering on the inputted speech by using filter coefficients calculated by the filter smoothing unit 103.

Accordingly, this allows extraction and modeling of the vocal tract information that is more stable than before. At the same time, this allows extraction and modeling of more accurate voicing source information which includes temporal fluctuations that are conventionally removed.

The thus-calculated vocal tract information and voicing source information include, with respect to each other, less unnecessary components than before. This produces an effect that degradation of sound quality is very small even when the vocal tract information and the voicing source information are separately transformed. Accordingly, this allows designing that achieves a higher degree of freedom in voice quality conversion, thus allowing the conversion into various voice qualities.

For example, the vocal tract information separated by a conventional speech separating apparatus is appended with a component essentially derived from the voicing source. Thus, when performing speaker conversion (that is, converting voice quality from a speaker A to a speaker B) or the like, the transformation is performed including the voicing source component of the speaker A although it is only intended to convert the vocal tract information of the speaker A. Thus, there is a problem of, for example, phonemic ambiguity because the same transformation process that is performed on the vocal tract information of the speaker A is to be performed on the voicing source components of the speaker A.

On the other hand, the vocal tract information and the voicing source information calculated according to the present invention contain less unnecessary components than before with respect to each other. This produces an effect that the degradation of sound quality is very small even when the vocal tract information and the voicing source information are independently transformed. Thus, this allows designing that achieves a higher degree of freedom in voice quality conversion, thus allowing the conversion into various voice qualities.

In addition, the filter smoothing unit 103 smoothes a PARCOR coefficient by using a polynomial with respect to each phoneme. This produces another effect of making it only necessary to hold, for each phoneme, the vocal tract parameter, which conventionally has to be held for each analysis period.

Figure 23:
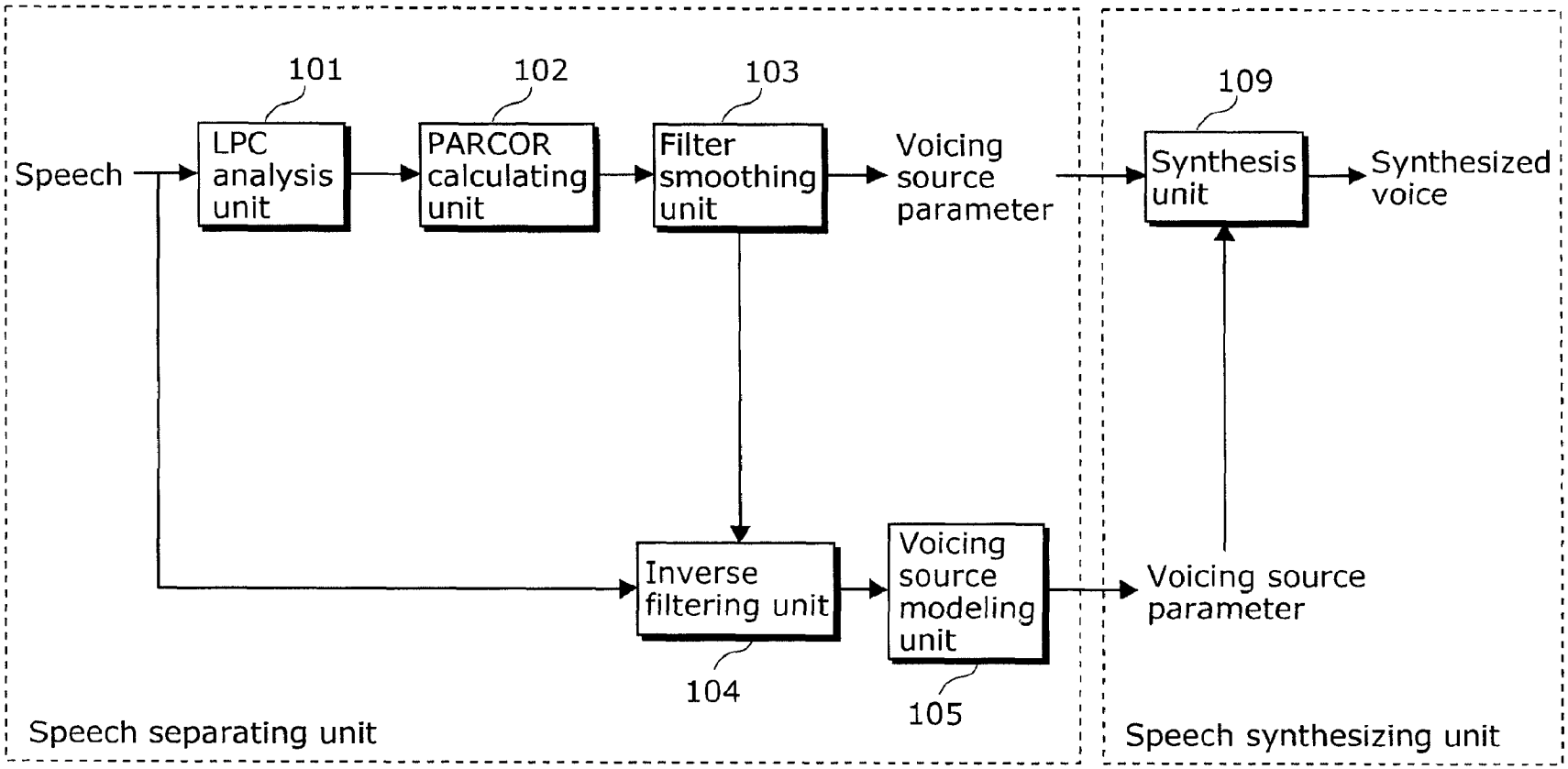
FIG. 23 is a block diagram showing a configuration of a speech synthesizing apparatus according to the first embodiment of the present invention.

Note that in the present embodiment, a combination of all the analysis, synthesis, and voice quality conversion of speech has been described, but the configuration may be such that each of them functions independently. For example, a speech synthesizing apparatus may be configured as shown in FIG. 23. The speech synthesizing apparatus may include a speech separating unit and a speech synthesizing unit, and these processing units may be separate apparatuses. For example, the speech synthesizing apparatus may include either one of a server and a mobile terminal device connected to the server via a network as the speech separating unit, and the other as the speech synthesizing unit. The speech synthesizing apparatus may also include either one of a server and two mobile terminal devices connected to the server via a network as the speech separating unit, and the other as the speech synthesizing unit. The speech synthesizing apparatus may also include, as a separate apparatus, a processing unit that performs voice quality conversion.

In addition, although the voicing source information has been modeled in each pitch period, the modeling need not necessarily be performed with that short time constant. It is still possible to maintain the effect of preserving some level of naturalness because the pitch period is also shorter than the time constant of the vocal tract in the modeling by selecting one pitch period from every few pitch period. The vocal tract information is approximated using a polynomial for the duration of a phoneme. Thus, assuming that the utterance speed in Japanese conversation is approximately 6 morae/second, one mora has a duration of approximately 0.17 second, a large part of which consists of vowels. Accordingly, the time constant for modeling the vocal tract is around 0.17 second. On the other hand, as for the voicing source information, assuming that the pitch frequency of a male speaker's utterance having a relatively low pitch is 80 Hz, one pitch period is: 1/80 second=0.013 second. Accordingly, the time constant is 0.013 second in the case of modeling the voicing source information in each pitch period, and the time constant is 0.026 second in the case of modeling in every two pitch periods. Thus, in the modeling in every few pitch periods, the time constant for modeling the voicing source information is sufficiently shorter than the time constant for modeling the vocal tract information.

Second Embodiment

The external view of the voice quality conversion apparatus according to a second embodiment of the present invention is the same as shown in FIG. 2.

Figure 24:
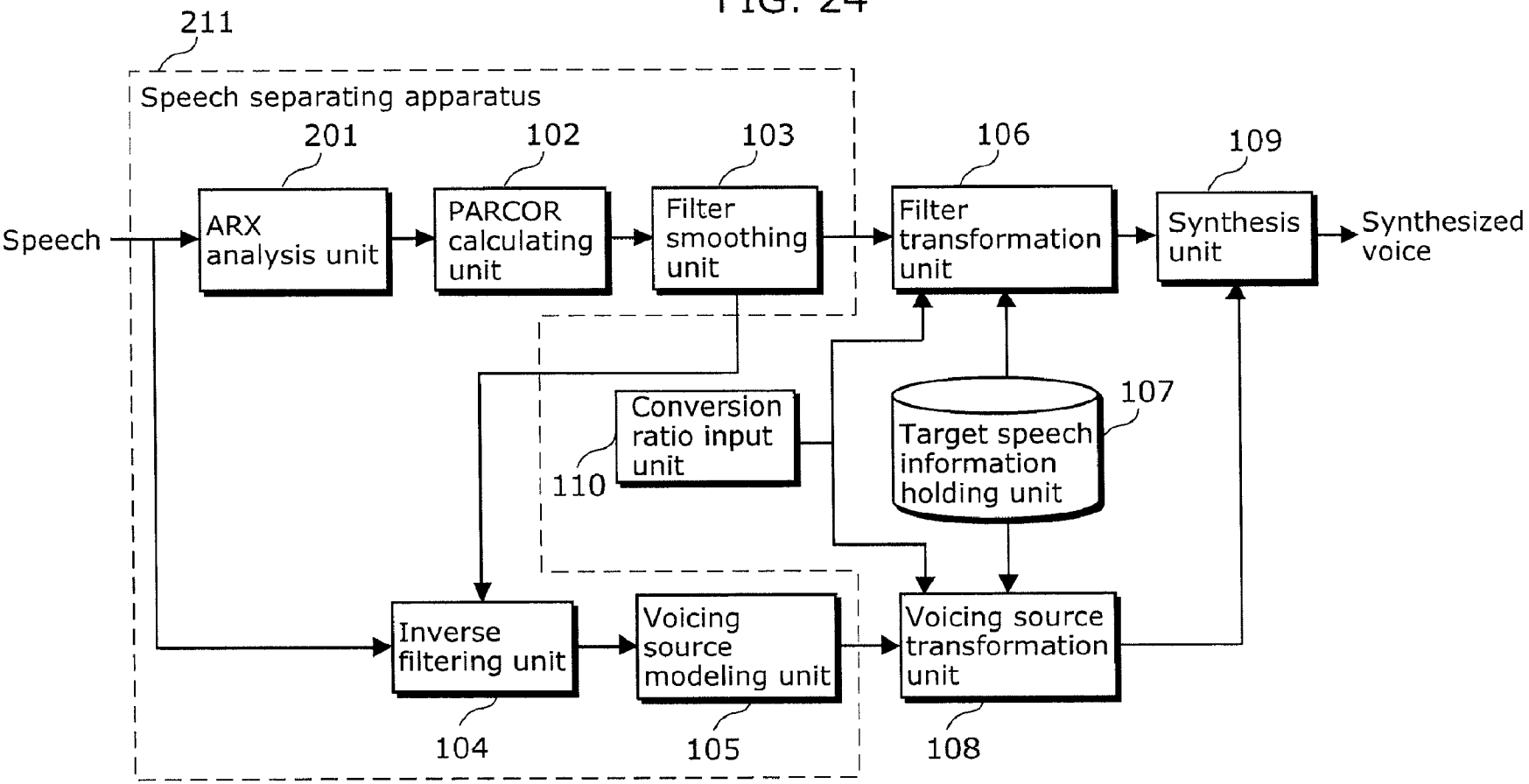
FIG. 24 is a block diagram showing a configuration of a voice quality conversion apparatus in a second embodiment of the present invention.
Figure 25A:
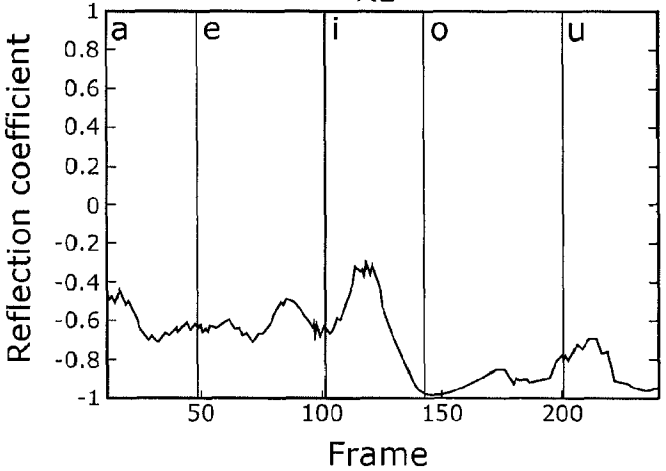
FIG. 25A is a diagram showing an example of a first-order PARCOR coefficient based on an ARX analysis.
Figure 25B:
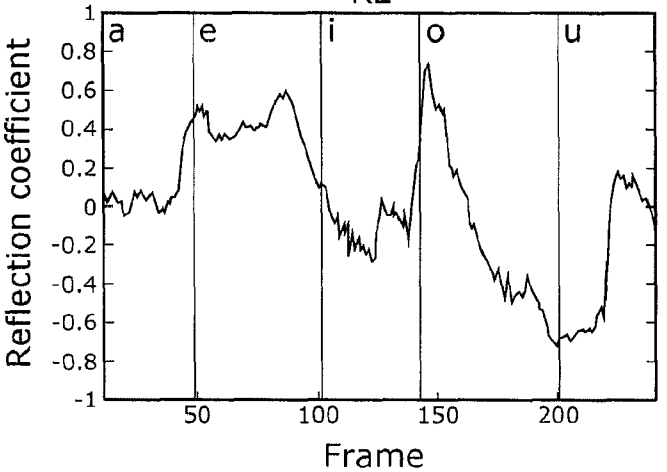
FIG. 25B is a diagram showing an example of a second-order PARCOR coefficient based on an ARX analysis.
Figure 25C:
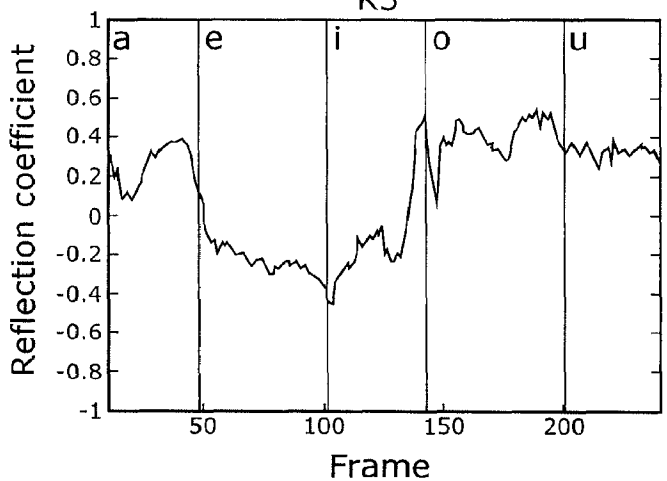
FIG. 25C is a diagram showing an example of a third-order PARCOR coefficient based on an ARX analysis.
Figure 25D:
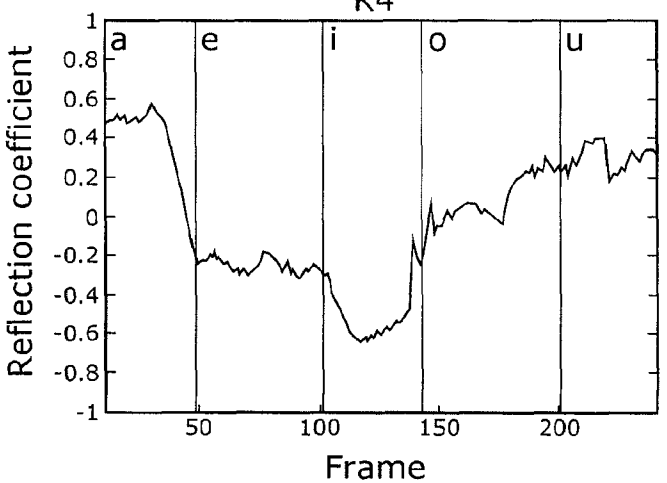
FIG. 25D is a diagram showing a fourth-order PARCOR coefficient based on an ARX analysis.
Figure 26A:
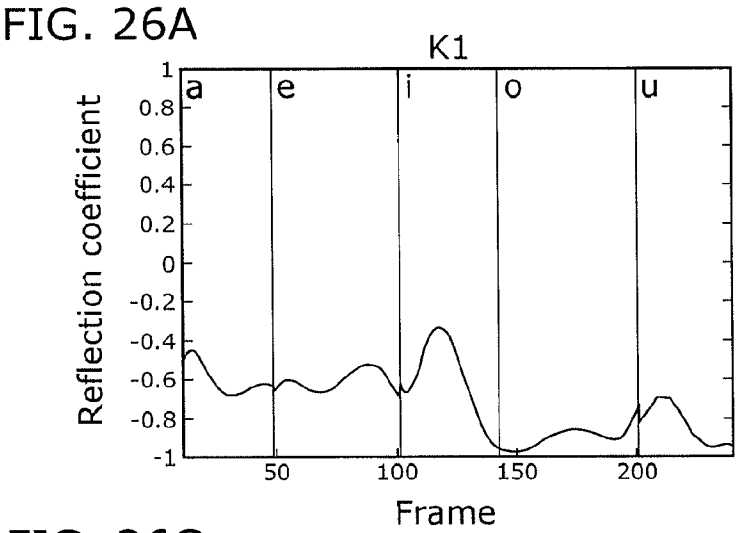
FIG. 26A is a diagram showing a result of smoothing, through approximation using a polynomial function, a first-order PARCOR coefficient based on an ARX analysis.
Figure 26B:
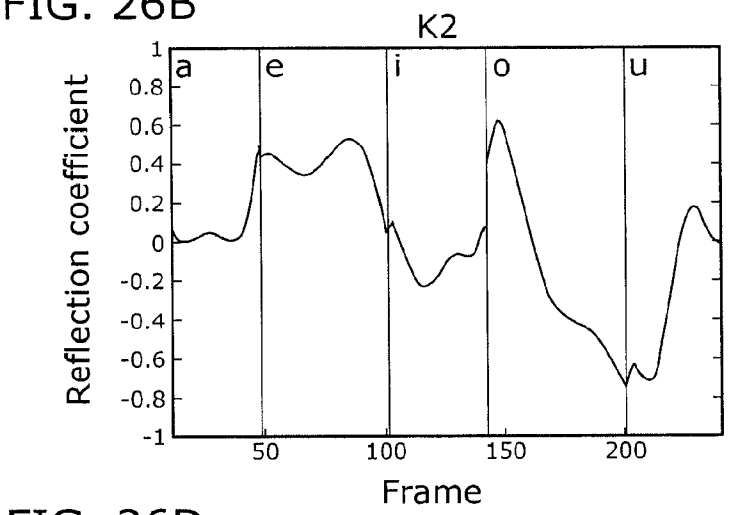
FIG. 26B is a diagram showing a result of smoothing, through approximation using a polynomial function, a second-order PARCOR coefficient based on an ARX analysis.
Figure 26C:
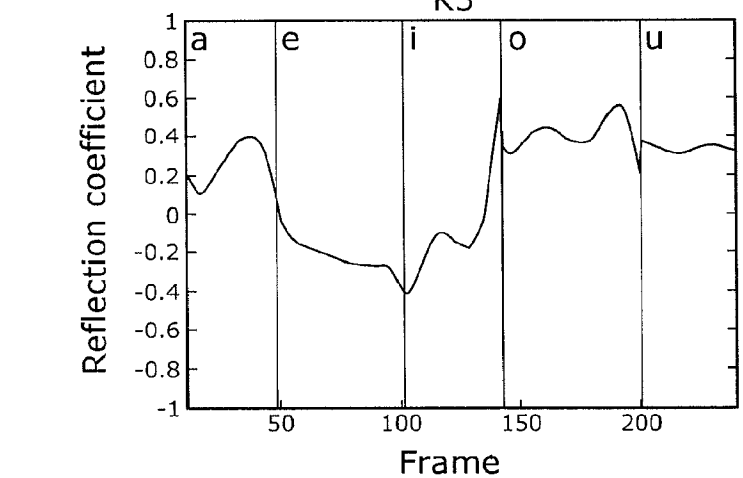
FIG. 26C is a diagram showing a result of smoothing, through approximation using a polynomial function, a third-order PARCOR coefficient based on an ARX analysis.
Figure 26D:
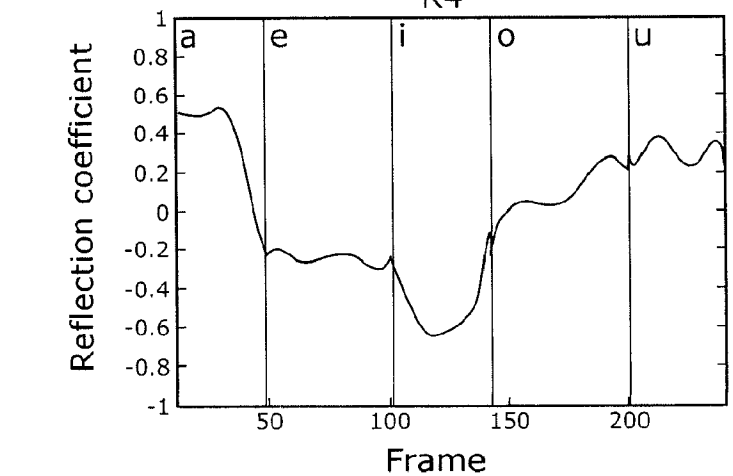
FIG. 26D is a diagram showing a result of smoothing, through approximation using a polynomial function, a fourth-order PARCOR coefficient based on an ARX analysis.

FIG. 24 is a block diagram showing a configuration of a voice quality conversion apparatus in the second embodiment of the present invention. In FIG. 24, the same constituent elements as in FIG. 3 are assigned with the same numerals, and the description thereof shall be omitted.

The second embodiment of the present invention is different from the first embodiment in that the speech separating apparatus 111 is replaced with a speech separating apparatus 211. The speech separating apparatus 211 is different from the speech separating apparatus in the first embodiment in that the LPC analysis unit 101 is replaced with an ARX analysis unit 201.

Hereinafter, the difference between the ARX analysis unit 201 and the LPC analysis unit 101 shall be described focusing on the effects produced by the ARX analysis unit 201, and the description of the same portions as those described in the first embodiment shall be omitted. The respective processing units included in the voice quality conversion apparatus are realized through execution of a program for realizing these processing units on a computer processor as shown in FIG. 2. In addition, various data is stored in the computer memory and used for the processing executed by the processor.

<ARX Analysis Unit 201>

The ARX analysis unit 201 separates vocal tract information and voicing source information by using an autoregressive with exogenous input (ARX) analysis. The ARX analysis widely differs from the LPC analysis in that in the ARX analysis a mathematical voicing source model is applied as a voicing source model. In addition, in the ARX analysis, when the analysis section includes plural fundamental frequencies, it is possible to separate with higher accuracy, unlike the LPC analysis, vocal tract information and voicing source information (Non-Patent Reference: Otsuka et al., Robust ARX-based Speech Analysis Method Taking Voicing Source Pulse Train into Account", The Journal of The Acoustical Society of Japan, vol. 58, No. 7, (2002) (Vol. 58 No. 7 (2002), pp. 386-397).

Assuming that a speech signal is S(z), vocal tract information is A(z), voicing source information is U(z), and unvoiced noise source E(z), the speech signal S(z) can be represented by Equation 10. Here, a characteristic point is that voicing source information generated by the Rosenberg-Klatt (RK) model shown in Equation 11 is used as the voicing source information U(z) in the ARX analysis.

[Expression 11]

$$S(z) = \frac{1}{A(z)}U(z) + \frac{1}{A(z)}E(z) \quad \text{(Equation 10)}$$

$$u(n) = \begin{cases} 2AV(nT_s - OQ \times T0) - 3b(nT_s - OQ \times T0)^2, & -OQ \times T0 < nT_s \leq 0 \\ 0, & \text{elsewhere} \end{cases} \quad \text{(Equation 11)}$$

However, S(z), U(z), and E(z) represent the z-transform of s(n), u(n), and e(n). In addition, AV represents voiced voicing source amplitude, Ts represents sampling period, T0 represents pitch period, and OQ represents glottal open quotient. The first term is used for voiced speech, and the second term is used for unvoiced speech.

Here, A(z) has the same format as the system function in the LPC analysis, thus allowing the PARCOR calculating unit 102 to calculate a PARCOR coefficient by the same method as in performing the LPC analysis.

The ARX analysis has the following advantages, compared with the LPC analysis.

(1) A voicing source pulse train corresponding to plural pitch frequencies is provided in the analysis window for performing the analysis. This allows stable extraction of vocal tract information from high-pitched speech of women, children or the like.

(2) Particularly, separation performance of the vocal tract and the voicing source is high for narrow vowels such as /i/ and /u/, in which F0 (fundamental frequency) and F1 (first formant frequency) are close to each other.

However, the ARX analysis has a disadvantage that a greater amount of processing is required than in the LPC analysis.

FIGS. 25A to 25D show PARCOR coefficients of first order to fourth order calculated by the PARCOR calculating unit 102 based on the vocal tract information, which is a result of the analysis performed by the ARX analysis unit 201 on the same speech as shown in FIGS. 5A to 5D.

By comparing FIGS. 25A to 25D with FIGS. 5A to 5D, respectively, it is clarified that the temporal fluctuations of each PARCOR coefficient are smaller than in the case of using the vocal tract information analyzed by the LPC analysis unit 101. This clarifies improved accuracy of extraction of vocal tract information as compared to the case of using the LPC analysis.

FIGS. 26A to 26D show results of smoothing of the PARCOR coefficients of first order to fourth order which are smoothed by the filter smoothing unit 103, respectively. These figures, when compared to FIGS. 25A to 25D, show that the temporal fluctuations of the vocal tract information are further smoothed.

It is clarified that the ARX analysis, compared to the case of using the LPC analysis, is less likely to be influenced by temporally short fluctuations and also allows maintaining the level of separation performance of the vocal tract and the voicing source in the smoothing, which is a characteristic of the ARX analysis.

The other processing is the same as the first embodiment.

(Effects)

Conventionally, as shown in FIGS. 25A to 25D, the vocal tract information extracted as PARCOR coefficients based on the ARX analysis includes fluctuations having a shorter time constant than that of the inherent temporal fluctuations of the vocal tract. However, according to the configuration described in this embodiment, it is possible to remove, as shown in FIGS. 26A to 26D, a component that is not a part of the inherent temporal fluctuations of the vocal tract information by smoothing the vocal tract information in a time direction.

In the ARX analysis, compared to the LPC analysis, vocal tract information that is more accurate and includes less fluctuation having a short time constant is successfully obtained. This allows further removal of fluctuations having a short time constant while retaining rough movements, thus improving accuracy of vocal tract information.

Furthermore, it is possible to obtain voicing source information which includes information that is conventionally removed, by performing inverse filtering on the inputted speech by using filter coefficients calculated by the filter smoothing unit 103.

Accordingly, this allows extraction and modeling of vocal tract information that is more stable than before. At the same time, this allows extraction and modeling of more accurate voicing source information which includes temporal fluctuations that are conventionally removed.

In addition, the filter smoothing unit 103 smoothes a PARCOR coefficient by using a polynomial with respect to each phoneme. This produces an effect of making it only necessary to hold, for each phoneme, the vocal tract parameter, which conventionally has to be held for each analysis period.

Figure 27:
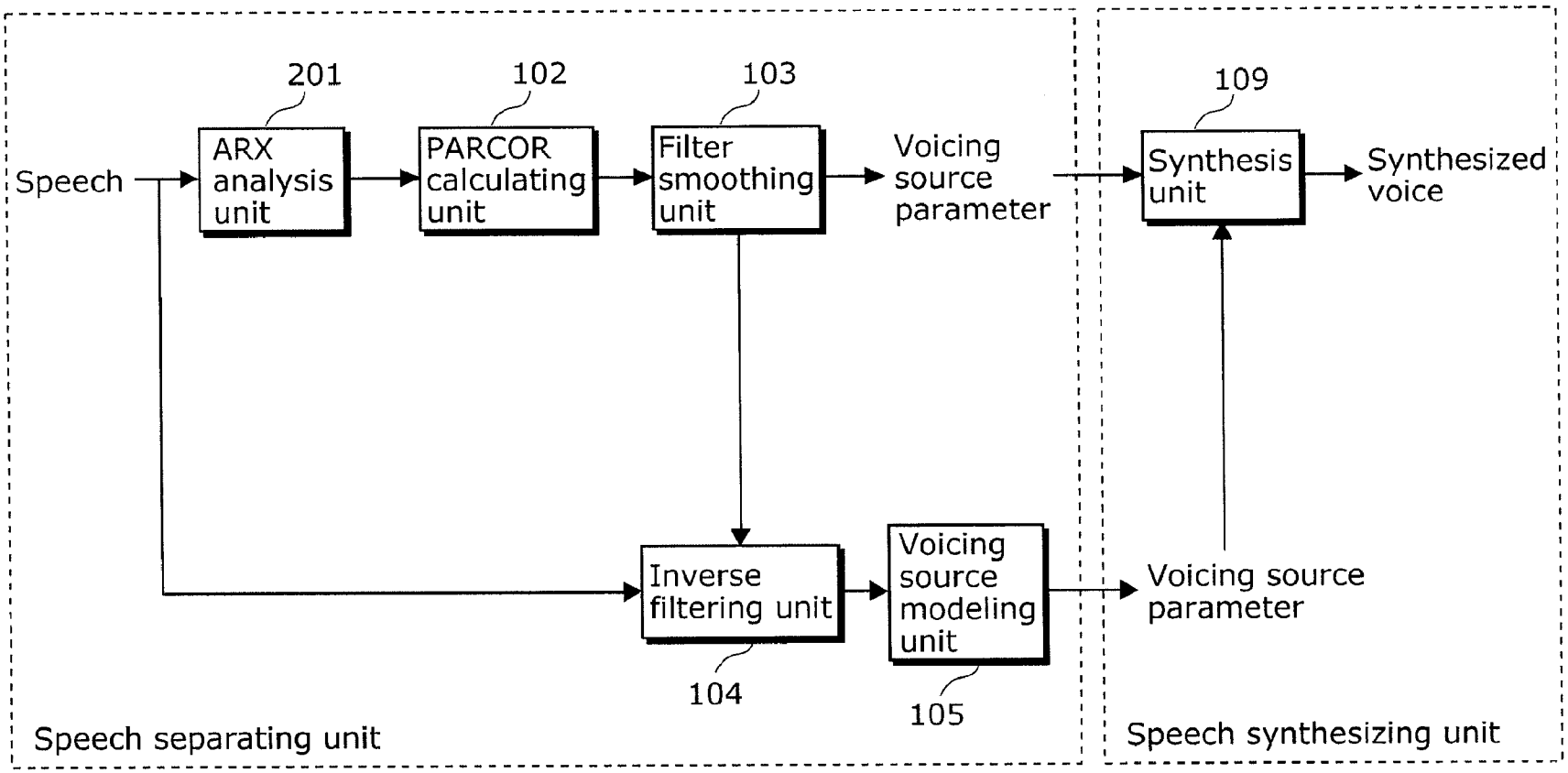
FIG. 27 is a block diagram showing a configuration of a speech synthesizing apparatus according to the second embodiment of the present invention.

Note that in the present embodiment, a combination of all the analysis, synthesis, and voice quality conversion of speech has been described, but the configuration may be such that each of them functions independently. For example, a speech synthesizing apparatus may be configured as shown in FIG. 27. The speech synthesizing apparatus may include a speech separating unit and a speech synthesizing unit, and these processing units may be separate apparatuses. In addition, the speech synthesizing apparatus may include as a separate apparatus, a processing unit that performs voice quality conversion.

Note that the description in the present specification assumes, for convenience sake, Japanese language and five vowels /a/, /i/, /u/, /e/, and /o/, but the differentiation between vowels and consonants is a concept independent of language. Thus, the scope of application of the present invention is not limited to the Japanese language, and the present invention is applicable to every language.

Note that the embodiments described thus far include inventions having the following structure.

The speech separating apparatus in an aspect of the present invention is a speech separating apparatus that separates an input speech signal into vocal tract information and voicing source information, and includes: a vocal tract information extracting unit that extracts vocal tract information from the input speech signal; a filter smoothing unit that smoothes, in a first time constant, the vocal tract information extracted by the vocal tract information extracting unit; an inverse filtering unit that calculates a filter having an inverse characteristic to a frequency response of the vocal tract information smoothed by the filter smoothing unit and filters the input speech signal by using the calculated filter; and a voicing source modeling unit that takes, from the input speech signal filtered by the inverse filtering unit, a waveform included in a second time constant shorter than the first time constant and calculates, for each waveform that is taken, voicing source information from the each waveform.

Here, the voicing source modeling unit may convert each waveform that is taken, into a representation of the frequency domain, may approximate, for each waveform, an amplitude spectrum included in a frequency band above a predetermined boundary frequency by using a first function, and may approximate an amplitude spectrum included in a frequency band not higher than a predetermined boundary frequency by using a second function of higher order than the first function, so as to output, as parameterized voicing source information, coefficients of the first and the second functions.

In addition, the first function may be a linear function.

Note that the voicing source modeling unit may approximate the amplitude spectra included in two frequency areas of the frequency band by using functions of second or higher order, respectively, so as to output, as parameterized voicing source information, coefficients of the functions of second or higher order.

In addition, the voicing source modeling unit may take a waveform from the input speech signal filtered by the inverse filtering unit, by gradually shifting a window function in a time axis direction in a pitch period of the input speech signal, and may convert into a parameter each waveform that is taken, the window function having approximately twice a length of the pitch period.

Here, intervals between adjacent window functions in the taking of the waveform may be synchronous with the pitch period.

The voice quality conversion apparatus in another aspect of the present invention is a voice quality conversion apparatus that converts a voice quality of an input speech signal, and includes: a vocal tract information extracting unit that extracts vocal tract information from the input speech signal; a filter smoothing unit that smoothes, in a first time constant, the vocal tract information extracted by the vocal tract information extracting unit; an inverse filtering unit that calculates a filter having an inverse characteristic to a frequency response of the vocal tract information smoothed by the filter smoothing unit and filters the input speech signal by using the calculated filter; a voicing source modeling unit that takes, from the input speech signal filtered by the inverse filtering unit, a waveform included in a second time constant shorter than the first time constant and calculates, for each waveform that is taken, parameterized voicing source information from the each waveform; a target speech information holding unit that holds vocal tract information and the parameterized voicing source information on a target voice quality; a conversion ratio input unit that inputs a conversion ratio for converting the input speech signal into the target voice quality; a filter transformation unit that converts, at the conversion ratio inputted by the conversion ratio input unit, the vocal tract information smoothed by the filter smoothing unit into the vocal tract information on the target voice quality, which is held by the target speech information holding unit; a voicing source transformation unit that converts, at the conversion ratio inputted by the conversion ratio input unit, the voicing source information parameterized by the voicing source modeling unit into the voicing source information on the target voice quality, which is held by the target speech information holding unit; and a synthesis unit that generates synthesized speech by generating a voicing source waveform by using the parameterized voicing source information transformed by the voicing source transformation unit and filtering the generated voicing source waveform by using the vocal tract information transformed by the filter transformation unit.

The filter smoothing unit may smooth the vocal tract information, through approximation using a polynomial or a regression line, in the time axis direction in a predetermined unit, the vocal tract information being extracted by the vocal tract information extracting unit, and the filter transformation unit may convert, at the conversion ratio inputted by the conversion ratio input unit, a coefficient of the polynomial or the regression line into the vocal tract information on the target voice quality held by the target speech information holding unit, the polynomial or the regression line being used when the vocal tract information is approximated by the filter smoothing unit.

Note that the filter transformation unit may further interpolate, by providing a transitional section having a predetermined time constant around the phoneme boundary, the vocal tract information included in the transitional section, by using the vocal tract information at starting and finishing points.

The voice quality conversion system in another aspect of the present invention is a voice quality conversion system that converts a voice quality of an input speech signal, and includes: a vocal tract information extracting unit that extracts vocal tract information from the input speech signal; a filter smoothing that smoothes, in a first time constant, the vocal tract information extracted by the vocal tract information extracting unit, by shifting the first time constant in the time axis direction; an inverse filtering unit that calculates a filter having an inverse characteristic to a frequency response of the vocal tract information smoothed by the filter smoothing unit and filters the input speech signal by using the calculated filter; a voicing source modeling unit that takes, from the input speech signal filtered by the inverse filtering unit, a waveform included in a second time constant shorter than the first time constant and calculates, for each waveform that is taken, parameterized voicing source information from each waveform, by shifting the second time constant in the time axis direction; a target speech information holding unit that holds vocal tract information and the parameterized voicing source information on a target voice quality; a conversion ratio input unit that inputs a conversion ratio for converting the input speech signal into the target voice quality; a filter transformation unit that converts, at the conversion ratio inputted by the conversion ratio input unit, the vocal tract information smoothed by the filter smoothing unit into the vocal tract information on the target voice quality, which is held by the target speech information holding unit; a voicing source transformation unit that converts, at the conversion ratio inputted by the conversion ratio input unit, the voicing source information parameterized by the voicing source modeling unit into the voicing source information on the target voice quality, which is held by the target speech information holding unit; and a synthesis unit that generates synthesized speech by generating a voicing source waveform by using the parameterized voicing source information transformed by the voicing source transformation unit, and filtering the generated voicing source waveform by using the vocal tract information transformed by the filter transformation unit, and the filter smoothing unit smoothes the vocal tract information, through approximation using a polynomial or a regression line, in the time axis direction in a predetermined unit, the vocal tract information being extracted by the vocal tract information extracting unit, and the filter transformation unit converts, at the conversion ratio inputted by the conversion ratio input unit, a coefficient of the polynomial or the regression line into the vocal tract information on the target voice quality held by the target speech information holding unit, the polynomial or the regression line being used when the vocal tract information is approximated by the filter smoothing unit, and also interpolates, by providing a transitional section having a predetermined time constant around the phoneme boundary, the vocal tract information included in the transitional section, by using the vocal tract information at starting and finishing points.

The speech separating method in another aspect of the present invention is a speech separating method for separating an input speech signal into vocal tract information and voicing source information, and includes: extracting vocal tract information from the input speech signal; smoothing, in a first time constant, the vocal tract information extracted in the extracting; calculating a filter having an inverse characteristic to a frequency response of the vocal tract information smoothed in the smoothing, and filtering the input speech signal by using the calculated filter; and taking, from the input speech signal filtered in the calculating, a waveform included in a second time constant shorter than the first time constant, and calculating, for each waveform that is taken, parameterized voicing source information from the each waveform.

Note that the speech separating method described above may also include generating synthesized speech by: generating a waveform by using a voicing source information parameter outputted in the taking, and filtering the generated voicing source waveform by using the vocal tract information smoothed in the smoothing.

In addition, the speech separating method described above further includes: inputting a conversion ratio for converting the input speech signal into the target voice quality; converting, at the conversion ratio inputted in the inputting, the vocal tract information smoothed in the smoothing into the vocal tract information on the target voice quality; and converting, at the conversion ratio inputted in the inputting, the voicing source information parameterized in the taking, into the voicing source information on the target voice quality, and in the generating, synthesized speech may be generated by generating a voicing source waveform by using the parameterized voicing source information transformed in the converting of the voicing source information, and filtering the generated voicing source waveform by using the vocal tract information transformed in the converting of the vocal tract information.

The embodiments disclosed here should not be considered limitative but should be considered illustrative in every aspect. The scope of the present invention is shown not by the above description but by the claims, and is intended to include all modifications within the scope of a sense and a scope equal to those of the claims.

INDUSTRIAL APPLICABILITY

The speech separating apparatus according to the present invention has a function to perform high-quality voice quality conversion by transforming vocal tract information and voicing source information, and is useful for user interface, entertainment, and so on requiring various voice qualities. The speech separating apparatus according to the present invention is also applicable to voice changers or the like in speech communication using cellular phones and so on.

The invention claimed is:

1. A speech separating apparatus that separates an input speech signal into vocal tract information and voicing source information, said speech separating apparatus comprising:

a processor;

a vocal tract information extracting unit configured to extract vocal tract information from the input speech signal;

a filter smoothing unit configured to smooth, in a first time constant, the vocal tract information extracted by said vocal tract information extracting unit;

an inverse filtering unit configured to calculate, using said processor, a filter having an inverse characteristic to a frequency response of the vocal tract information smoothed by said filter smoothing unit, and to filter the input speech signal by using the calculated filter; and a voicing source modeling unit configured to take, from the input speech signal filtered by said inverse filtering unit, a waveform included in a second time constant shorter than the first time constant, and to calculate, for each waveform that is taken, voicing source information from the each waveform.

2. The speech separating apparatus according to claim 1, wherein said voicing source modeling unit is configured to convert the each waveform into a representation of a frequency domain, and to approximate, for the each waveform, an amplitude spectrum in the frequency domain by using a function, so as to output, as parameterized voicing source information, a coefficient of the function used for the approximation.

3. The speech separating apparatus according to claim 2, wherein said voicing source modeling unit is configured to convert the each waveform into the frequency domain representation, and to approximate, for the each waveform, the amplitude spectrum by using a function that is different from one frequency band to another, so as to output, as parameterized voicing source information, a coefficient of the function used for the approximation.

4. The speech separating apparatus according to claim 2, wherein said voicing source modeling unit is configured to approximate the amplitude spectrum by using the function with respect to each of boundary frequency candidates previously provided, and to output, along with the coefficient of the function, one of the boundary frequency candidates at a point at which a difference between the amplitude spectrum and the function is a minimum.

5. The speech separating apparatus according to claim 1, wherein said vocal tract information extracting unit includes:

an all-pole model analysis unit configured to analyze the input speech signal based on an all-pole model, and to calculate an all-pole vocal tract model parameter that is a parameter for an acoustic-tube model in which a vocal tract is divided into plural sections; and a reflection coefficient parameter calculating unit configured to convert the all-pole vocal tract model parameter into a reflection coefficient parameter that is a parameter for the acoustic-tube model or a parameter convertible into the reflection coefficient parameter.

6. The speech separating apparatus according to claim 5, wherein said all-pole model analysis unit is configured to calculate the all-pole vocal tract model parameter by performing a linear predictive analysis on the input speech signal.

7. The speech separating apparatus according to claim 5, wherein said all-pole model analysis unit is configured to calculate the all-pole vocal tract model parameter by performing an autoregressive exogenous analysis on the input speech signal.

8. The speech separating apparatus according to claim 1, wherein said filter smoothing unit is configured to smooth the vocal tract information, by using a polynomial or a regression line, in a time axis direction in a predetermined unit, the vocal tract information being extracted by said vocal tract information extracting unit.

9. The speech separating apparatus according to claim 8, wherein the predetermined unit is phoneme, syllable, or mora.

10. The speech separating apparatus according to claim 1, wherein said voicing source modeling unit is configured to:

take a waveform from the input speech signal filtered by said inverse filtering unit, by gradually shifting a window function in a time axis direction in a pitch period of the input speech signal, the window function having approximately twice a length of the pitch period;

convert each waveform that is taken, into the representation of the frequency domain;

calculate, for the each waveform, an amplitude spectrum from which phase information included in every frequency component is removed; and approximate the amplitude spectrum by using a function, so as to output, as parameterized voicing source information, a coefficient of the function used for the approximation.

11. A speech synthesizing apparatus that generates synthesized speech by using vocal tract information and voicing source information included in an input speech signal, said speech synthesizing apparatus comprising:

a processor;

a vocal tract information extracting unit configured to extract vocal tract information from the input speech signal;

a filter smoothing unit configured to smooth, in a first time constant, the vocal tract information extracted by said vocal tract information extracting unit;

an inverse filtering unit configured to calculate, using said processor, a filter having an inverse characteristic to a frequency response of the vocal tract information smoothed by said filter smoothing unit, and to filter the input speech signal by using the calculated filter;

a voicing source modeling unit configured to take, from the input speech signal filtered by said inverse filtering unit, a waveform included in a second time constant shorter than the first time constant, and to calculate, for each waveform that is taken, parameterized voicing source information from the each waveform; and a synthesis unit configured to generate synthesized speech by generating a voicing source waveform by using a voicing source information parameter outputted from said voicing source modeling unit, and filtering the generated voicing source waveform by using the vocal tract information smoothed by said filter smoothing unit.

12. The speech synthesizing apparatus according to claim 11, wherein said voicing source modeling unit is configured to take a waveform from the input speech signal filtered by said inverse filtering unit, by gradually shifting a window function in a time axis direction in a pitch period of the input speech signal, and to convert into a parameter each waveform that is taken, the window function having approximately twice a length of the pitch period, and said synthesis unit is configured to generate synthesized speech by: generating a voicing source waveform by using the parameter outputted from said voicing source modeling unit; generating a temporally-continuous voicing source waveform by laying out the generated voicing source waveform so as to create overlaps of the generated voicing source waveform in the time axis direction; and filtering the generated temporally-continuous voicing source waveform by using the vocal tract information smoothed by said filter smoothing unit.

13. The speech synthesizing apparatus according to claim 12, wherein said voicing source modeling unit is configured to convert the each waveform into a representation of a frequency domain, and to calculate, for the each waveform, an amplitude spectrum from which phase information included in every frequency component is removed, and said synthesis unit is configured to generate synthesized speech by: converting the amplitude spectrum into a voicing source waveform represented by a time domain; generating a temporally-continuous voicing source waveform by laying out the voicing source waveform so as to create overlaps of the voicing source waveform in the time axis direction; and filtering the generated temporally-continuous voicing source waveform by using the vocal tract information smoothed by said filter smoothing unit.

14. The speech synthesizing apparatus according to claim 13, wherein said voicing source modeling unit is further configured to approximate the amplitude spectrum by using a function, and to output, as parameterized voicing source information, the coefficient of the function used for the approximation, and said synthesis unit is configured to generate synthesized speech by: restoring the amplitude spectrum from the function represented by the coefficient outputted from said voicing source modeling unit; converting the amplitude spectrum into a voicing source waveform represented by the time domain; generating a temporally-continuous voicing source waveform by laying out the voicing source waveform so as to create overlaps of the voicing source waveform in the time axis direction; and filtering the generated temporally-continuous voicing source waveform by using the vocal tract information smoothed by said filter smoothing unit.

15. A voice quality conversion apparatus that converts a voice quality of an input speech signal, said voice quality conversion apparatus comprising:

a processor;

a vocal tract information extracting unit configured to extract vocal tract information from the input speech signal;

a filter smoothing unit configured to smooth, in a first time constant, the vocal tract information extracted by said vocal tract information extracting unit;

an inverse filtering unit configured to calculate, using said processor, a filter having an inverse characteristic to a frequency response of the vocal tract information smoothed by said filter smoothing unit, and to filter the input speech signal by using the calculated filter;

a voicing source modeling unit configured to take, from the input speech signal filtered by said inverse filtering unit, a waveform included in a second time constant shorter than the first time constant, and to calculate, for each waveform that is taken, parameterized voicing source information from the each waveform;

a target speech information holding unit configured to hold vocal tract information and the parameterized voicing source information on a target voice quality;

a conversion ratio input unit configured to input a conversion ratio for converting the input speech signal into the target voice quality;

a filter transformation unit configured to convert, at the conversion ratio inputted by said conversion ratio input unit, the vocal tract information smoothed by said filter smoothing unit into the vocal tract information on the target voice quality, which is held by said target speech information holding unit;

a voicing source transformation unit configured to convert, at the conversion ratio inputted by said conversion ratio input unit, the voicing source information parameterized by said voicing source modeling unit into the voicing source information on the target voice quality, which is held by said target speech information holding unit; and a synthesis unit configured to generate synthesized speech by generating a voicing source waveform by using the parameterized voicing source information transformed by said voicing source transformation unit, and filtering the generated voicing source waveform by using the vocal tract information transformed by said filter transformation unit.

16. The voice quality conversion apparatus according to claim 15, wherein said filter smoothing unit is configured to smooth the vocal tract information, through approximation using a polynomial or a regression line, in a time axis direction in a predetermined unit, the vocal tract information being extracted by said vocal tract information extracting unit, and said filter transformation unit is configured to convert, at the conversion ratio inputted by said conversion ratio input unit, a coefficient of the polynomial or the regression line into the vocal tract information on the target voice quality held by said target speech information holding unit, the polynomial or the regression line being used when the vocal tract information is approximated by said filter smoothing unit.

17. A method of separating an input speech signal into vocal tract information and voicing source information, said method comprising:

extracting vocal tract information from the input speech signal;

smoothing, in a first time constant, the vocal tract information extracted in said extracting;

calculating, using a processor, a filter having an inverse characteristic to a frequency response of the vocal tract information smoothed in said smoothing, and filtering the input speech signal by using the calculated filter; and taking, from the input speech signal filtered in said calculating, a waveform included in a second time constant shorter than the first time constant, and calculating, for each waveform that is taken, voicing source information from the each waveform.

18. A non-transitory computer readable recording medium having stored thereon program for separating an input speech signal into vocal tract information and voicing source information, wherein, when executed, said program causes a computer to execute a method comprising:

extracting vocal tract information from the input speech signal;

smoothing, in a first time constant, the vocal tract information extracted in the extracting;

calculating a filter having an inverse characteristic to a frequency response of the vocal tract information smoothed in the smoothing, and filtering the input speech signal by using the calculated filter; and taking, from the input speech signal filtered in the calculating, a waveform included in a second time constant shorter than the first time constant, and calculating, for each waveform that is taken, voicing source information from the each waveform.

* * * * *